US009924804B2

(12) United States Patent
Hartley

(10) Patent No.: US 9,924,804 B2
(45) Date of Patent: Mar. 27, 2018

(54) MATTRESS FOUNDATIONS, KITS AND RELATED METHODS

(71) Applicant: Ricky L Hartley, Trinity, NC (US)

(72) Inventor: Ricky L Hartley, Trinity, NC (US)

( * ) Notice: Subject to any disclaimer, the term of this patent is extended or adjusted under 35 U.S.C. 154(b) by 0 days.

(21) Appl. No.: 14/946,313

(22) Filed: Nov. 19, 2015

(65) Prior Publication Data

US 2016/0143446 A1 May 26, 2016

Related U.S. Application Data

(60) Provisional application No. 62/082,423, filed on Nov. 20, 2014.

(51) Int. Cl.

*A47C 19/02* (2006.01)
*A47C 19/00* (2006.01)
*A47C 23/06* (2006.01)

(52) U.S. Cl.

CPC ..... *A47C 19/025* (2013.01); *A47C 19/005* (2013.01); *A47C 19/021* (2013.01); *A47C 23/062* (2013.01)

(58) Field of Classification Search

CPC ..... A47C 19/005; A47C 19/02; A47C 19/021; A47C 19/025; A47C 23/06; A47C 23/061; A47C 23/062

USPC ..... 5/236.1, 200.1, 201, 282.1, 285, 286, 5/288, 400, 186.1

See application file for complete search history.

(56) References Cited

U.S. PATENT DOCUMENTS 3,080,576 A * 3/1963 Cervisi ..... A47C 23/05 5/200.1
3,469,589 A 9/1969 Mitchell
3,605,141 A * 9/1971 Silverman ..... A47C 19/021 5/200.1
3,842,451 A 10/1974 McCormick ..... 5/200 R
3,967,331 A * 7/1976 Glassman ..... A47C 23/30 5/236.1
3,992,732 A * 11/1976 Cervisi ..... A47C 23/05 5/263
4,074,372 A 2/1978 Schulz, Jr. ..... 5/263
4,136,988 A * 1/1979 Nist ..... A47C 19/021 403/231
4,181,991 A 1/1980 Morgan et al. ..... 5/400
4,535,494 A 8/1985 Diamonstein ..... 5/400
5,701,653 A * 12/1997 Rupe ..... A47C 19/021 29/432
5,758,372 A 6/1998 Lopez Diaz ..... 5/200.1
5,983,423 A * 11/1999 Rupe ..... A47C 19/021 5/200.1
6,058,535 A 5/2000 Firkins, Jr. et al. ..... 5/653
6,286,161 B1 * 9/2001 McCall ..... A47C 19/02 403/231
7,784,122 B2 8/2010 Oh ..... 5/201
7,937,788 B2 5/2011 Felix ..... 5/201

(Continued)

*Primary Examiner* — Robert G Santos
(74) *Attorney, Agent, or Firm* — MacCord Mason PLLC

(57) ABSTRACT

Mattress foundations and foundation corners, methods, and kits include a first side rail, a second side rail, a first end rail, and a second end rail. In one example, the rails join at corners to form the frame of the foundation and the rails may include at least a partial overlap between the rail the corners. The foundations and kits further include a plurality of slats. The slats may be of varying lengths. The invention may further include a method of assembling a foundation kit.

12 Claims, 25 Drawing Sheets

(56) References Cited

U.S. PATENT DOCUMENTS

| | | | | |
|---|---|---|---|---|
| 8,042,205 | B2 | 10/2011 | Schulz, Jr. | 5/200.1 |
| 8,091,161 | B1 * | 1/2012 | Schulz, Jr. | A47C 23/00 5/186.1 |
| 8,176,581 | B2 * | 5/2012 | Schulz, Jr. | A47C 19/005 5/200.1 |
| D682,594 | S | 5/2013 | Hartley | D6/606 |
| 8,935,819 | B1 | 1/2015 | Hartley | 5/400 |
| 8,959,678 | B2 * | 2/2015 | Schulz, Jr. | A47C 19/025 5/191 |
| D756,689 | S * | 5/2016 | Hartley | D6/606 |
| 9,538,851 | B2 * | 1/2017 | Craver | A47C 19/005 |
| 9,596,943 | B1 * | 3/2017 | Hartley | A47C 23/061 |
| 9,782,013 | B2 * | 10/2017 | Craver | A47C 19/005 |
| 9,808,094 | B2 * | 11/2017 | Schulz, Jr. | A47C 23/061 |
| 2007/0151026 | A1 | 7/2007 | Felix | 5/201 |
| 2008/0208709 | A1 | 8/2008 | Craver | 705/27 |
| 2008/0235868 | A1 | 10/2008 | Snitzer et al. | 5/201 |
| 2009/0000030 | A1 * | 1/2009 | Hicks | A47C 19/005 5/400 |
| 2010/0154118 | A1 | 7/2010 | Pearce | 5/201 |
| 2010/0170190 | A1 | 7/2010 | Schul, Jr. | 52/745.19 |
| 2011/0258777 | A1 * | 10/2011 | Schulz, Jr. | A47C 19/005 5/286 |
| 2013/0000038 | A1 * | 1/2013 | Schulz, Jr. | A47C 19/025 5/400 |
| 2013/0263970 | A1 | 10/2013 | Schultz, Jr. et al. | 141/301 |
| 2015/0128342 | A1 | 5/2015 | Schulz, Jr. | |
| 2016/0143446 | A1 * | 5/2016 | Hartley | A47C 19/025 5/236.1 |
| 2016/0255963 | A1 * | 9/2016 | Jones | A47C 19/025 |
| 2017/0042336 | A1 * | 2/2017 | Craver | A47C 19/005 |
| 2017/0079443 | A1 * | 3/2017 | Craver | A47C 19/005 |

* cited by examiner

MATTRESS FOUNDATIONS, KITS AND RELATED METHODS

This application claims the benefit of U.S. Provisional Application Ser. No. 62/082,423 filed Nov. 20, 2014, which is incorporated by reference.

BACKGROUND

The current disclosure relates generally to foundations for mattresses to increase mattress support and foundation frame stability, and more particularly to foundations having novel corners to improve frame stability.

While traditional foundations are sufficient in many situations, applicant believes that in some situations, by way of example, when frames are purchased unassembled and then assembled by the consumer, improvement can be made, especially in the ease of assembly and foundation stability.

In some situations, frame stability may be compromised such that the general rectangular shape of the frame may sway, for example, taking on a slight parallelogram type shaping, or be difficult to maintain, especially when the mattress foundation is moved or relocated. In situations where foundations are purchased and then assembled, especially by the end consumer, ease of assembly and stability of the assembled foundation are often opposing forces. Fewer tools required for assembly and minimized assembly time are often desirable. However, achieving quick and easy assembly typically requires pre-assembling some parts of the frame of the foundation, thus increasing packaging complexity and shipping costs or sacrificing stability of the foundation. Accordingly, this disclosure is directed to these and other challenges.

SUMMARY

The current disclosure is directed to a variety of kits for making a foundation for a mattress, methods of assembling kits for shipping, methods of assembling foundations from kits, mattress foundations and foundation corners.

In one example of one kit embodiment, a kit includes a first side rail, a second side rail, a first end rail, a second end rail. The kit may include at least one center rail. The first and second side rails are configured to be positioned parallel to each other. The first and second end rails are configured to interface with the first and second side rails. In an embodiment with the at least one center rail, the center rail will typically be configured to be positioned parallel to the first and second side rails and to interface with the first and second end rails.

Kit examples will also typically include a plurality of slats. In some examples, some of the slats may have different lengths. The kit described above may include, for example, an A slat having a length L-A, a B slat having a length L-B, wherein L-B is greater than L-A, and a C slat having a length L-C, wherein L-C is greater than L-B. In one example, the plurality of slats are positioned parallel to the first and second end rails, typically interfacing with the rails and/or slat rests. In another example, when the various rails are interfaced, the A slat, B slat, and C slat may be positioned on slats and/or slat-rests of the rails in a non-parallel manner to the rails.

In this embodiment, where slats are positioned non-perpendicularly to side rails, kits of the current inventions are configured such that at least a plurality of slats are non-perpendicular to the side rails. For example, the A slat, the B slat, and the C slat may each define an angle $\alpha$ in the range of 25° to 35°. A plurality of additional slats may define similar angles. For example, kits may include a pair of A slats, a pair of B slats, and a pair of C slats that define an angle $\alpha$ in the range of 25° to 35°. In some examples, at least some of the slats may be connected by at least one flexible line, e.g. fabric tape. In many examples, the fabric tape may maintain a desired spacing and order between slats.

In some examples, where the side rails join the end rails, at the corners of the frame, the side rail and the end rail overlap. In some instances the overlap is created by a top portion of one of the rails extending over a top portion of the other rail at the corner. The top portions of the rails may have radiuses at their ends so that the radius edge is where the end rail and the side rail overlaps. A spacer may be included at the corner. A bottom portion of the rails may meet flush at the corner without overlapping. Stabilizers may be included that recess into each of the rails. Adjoining fasteners, such as, for example screws, nails, and glue may be included to further secure the corners. The results include mattress foundations, mattress foundation corners, and kits that allow for the creation of foundations having increased stability and support.

In some aspects of the disclosure, the rails and slats may be packaged together for shipping and storage in a substantially parallel longitudinal orientation.

In some embodiments, a mattress foundation includes a first side rail having a slat-rest, a second side rail for positioning parallel to the first side rail, the second side rail having a slat-rest, a first end rail configured to interface with the first side rail and the second side rail, a second end rail configured to interface with the first side rail and the second side rail, a plurality of slats, and a corner between each of the interfaces of the side rails and end rails. The corner may be formed by the overlap of at least one of the end portions of the end rails and at least one of the end portions of the side rails.

In other embodiments, a corner insert may be included for attaching the rails at the corners.

The above summary was intended to summarize briefly some parts of the present disclosure. Kits, foundations, foundation corners, and related methods will be set forth in more detail in the figures and detailed description below. It will be apparent, however, that the detailed description is not intended to limit the present invention, the scope of which should be properly determined by the appended examples.

DETAILED DESCRIPTION OF THE DISCLOSURE

Figure 1:
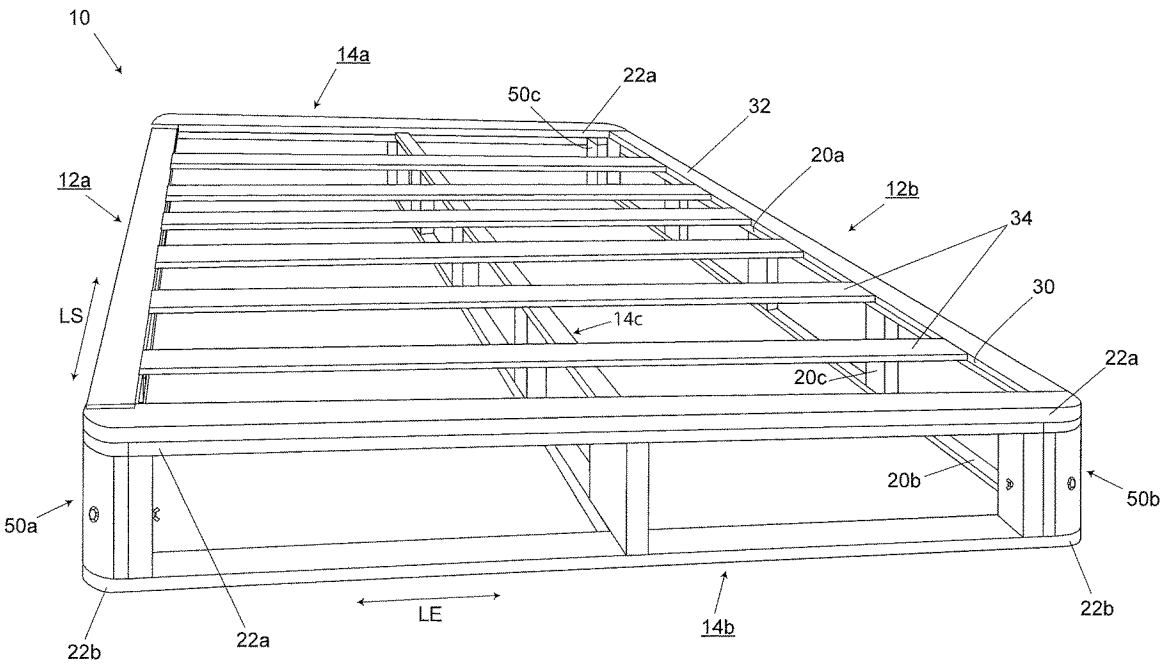
FIG. 1 shows a perspective end view of one example of a foundation according to the present disclosure.
Figure 2:
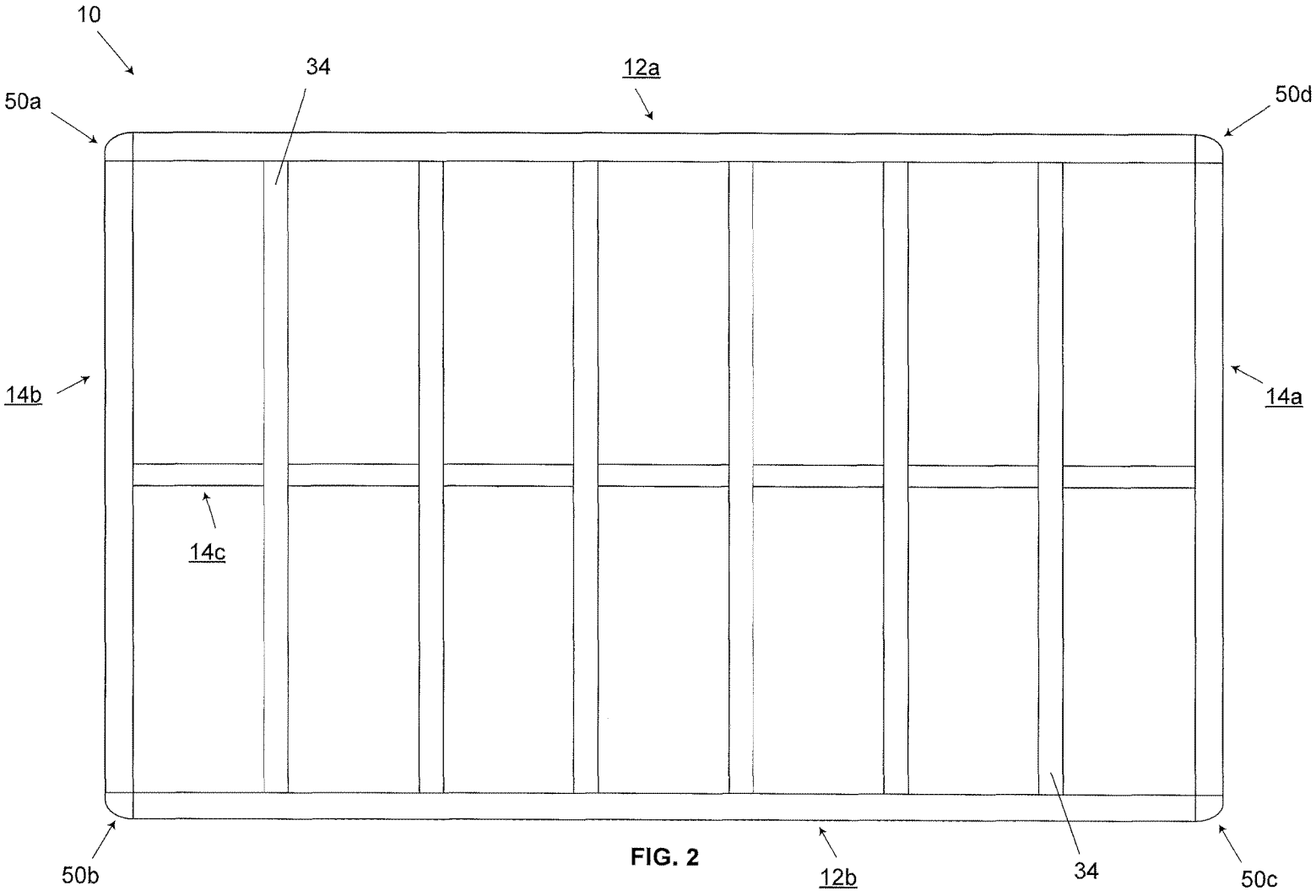
FIG. 2 shows a top view of one example of a foundation according to the present disclosure.
Figure 3:
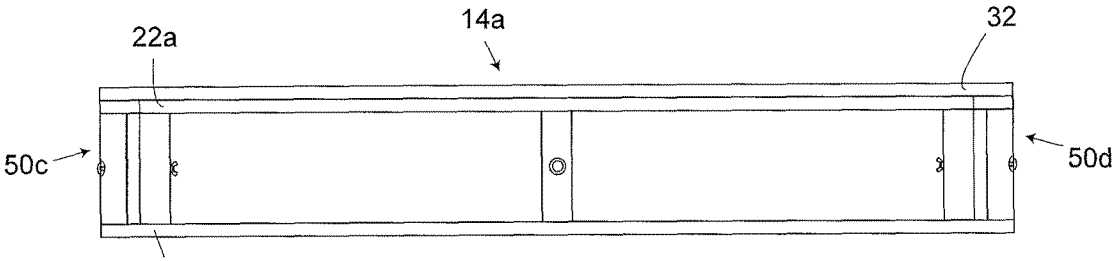
FIG. 3 shows an end view of one example of a foundation according FIG. 1.
Figure 4:
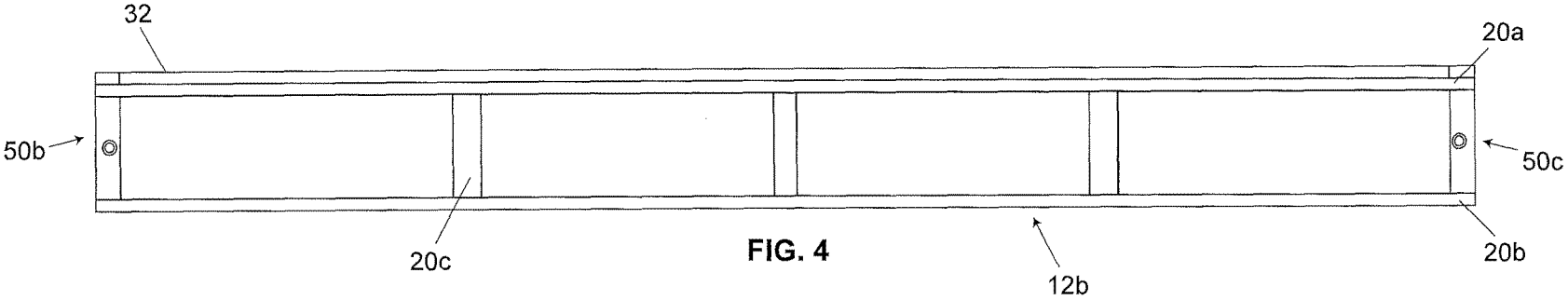
FIG. 4 shows a side view of one example of a foundation according FIG. 1.
Figure 5:
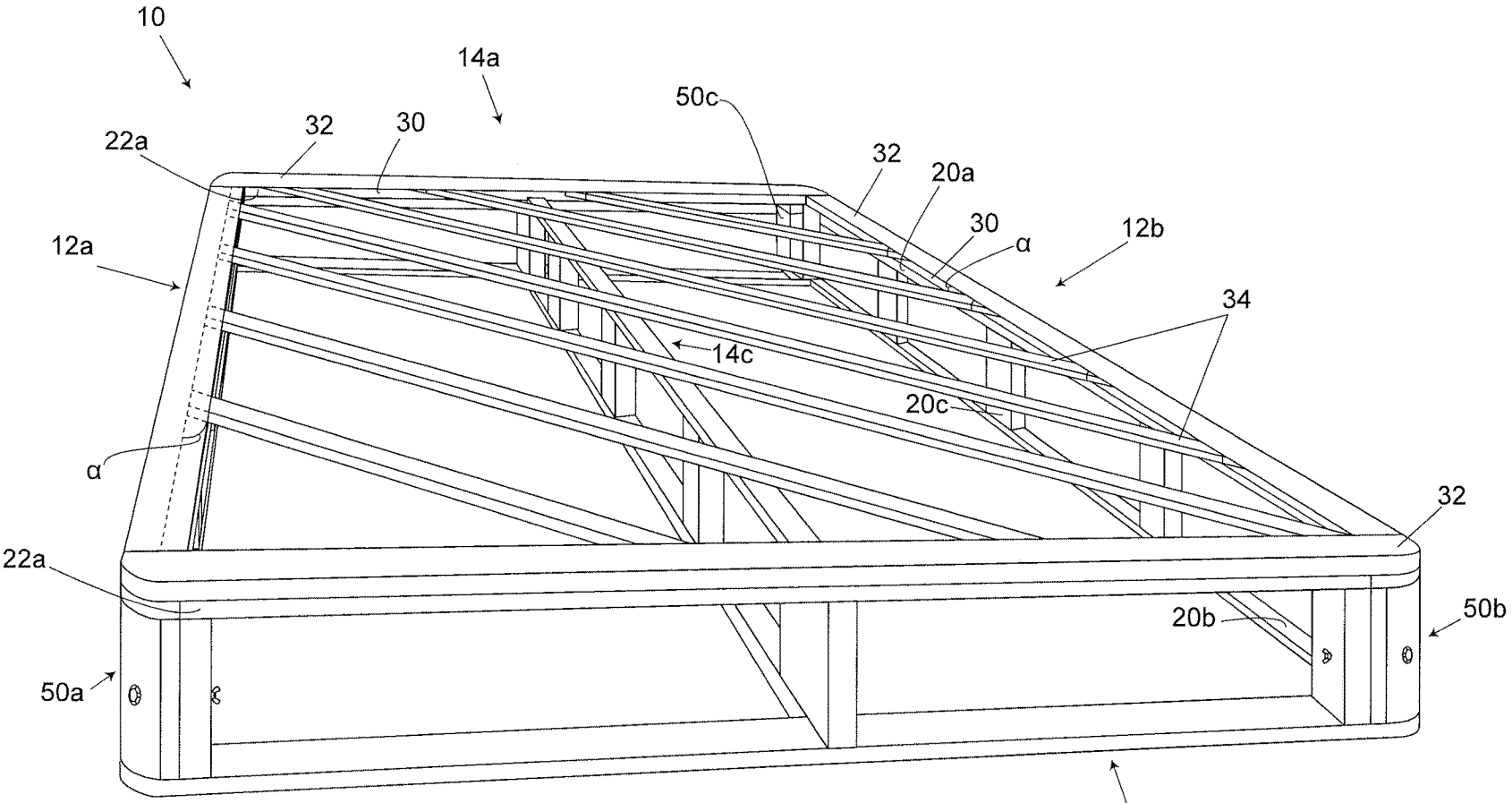
FIG. 5 shows a perspective end view of another example of a foundation according to the present disclosure.
Figure 6:
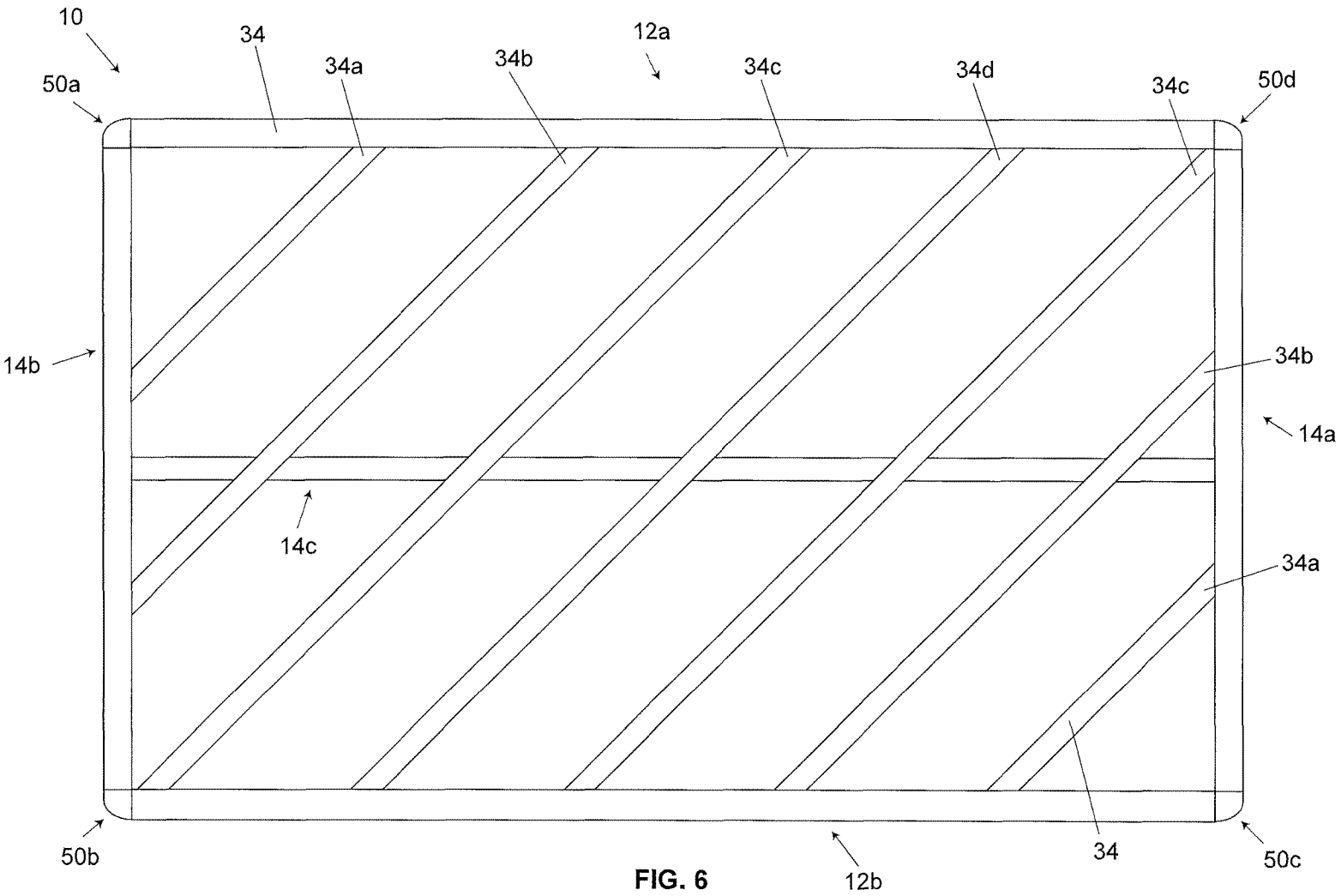
FIG. 6 shows a top view of one example of a foundation according FIG. 5.
Figure 7:
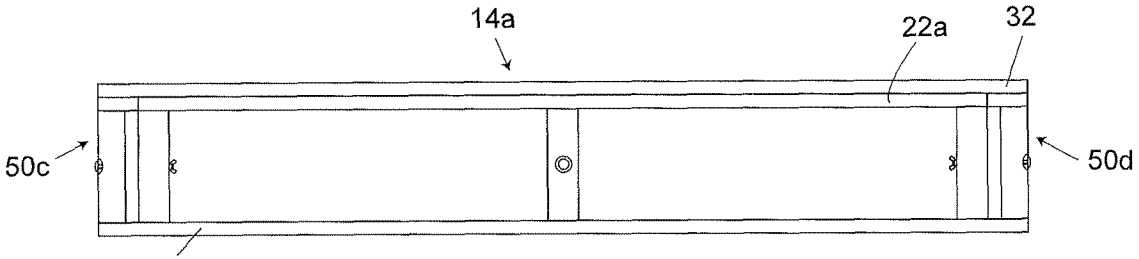
FIG. 7 shows an end view of one example of a foundation according FIG. 5.
Figure 8:
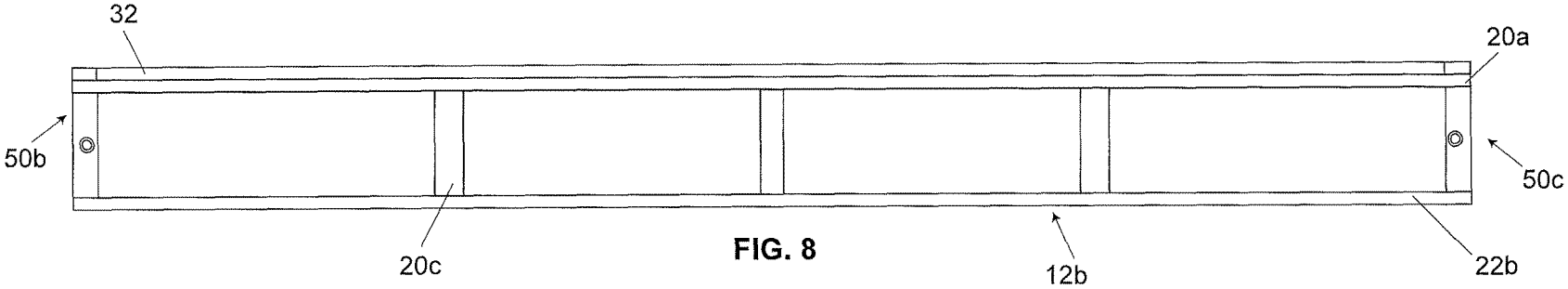
FIG. 8 shows a side view of one example of a foundation according FIG. 5.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms. The illustrations are for the purpose of describing preferred embodiments of the invention and are not intended to limit the invention thereto.

Referring to the figures generally and FIGS. 1-4 more specifically, FIG. 1 is a perspective end view of one example of an assembled mattress foundation according to the present disclosure, referred to generally as 10. Foundation 10 includes a plurality of slats 34 positioned substantially perpendicular to the length LS of the foundation. Slats 34 support a mattress not shown in this picture. Slats 34 may or may not have the same length.

In this example, the foundation includes a first side rail 12*a*, a second side rail 12*b*, a first end rail 14*a* and a second end rail 14*b*. In some instances, a center rail 14*c* may also be included.

The construction of the various rails may vary from embodiment to embodiment. For example, side rails 12 may include a top piece 20*a*, a bottom piece 20*b* and a side filler block 20*c*. Similarly, end rails may include a top piece 22*a*, a bottom piece 22*b*, and an end filler piece 22*c* (not shown). The center rail 14*c* may also include a top piece, a bottom piece, and a center filler piece. In other examples, other rail constructions may be used, including, for example, solid rail pieces, or different spacer constructions.

The foundation 10 may also include corners 50. Corners may be made of one corner portions and/or assembled by way of more than one parts. Corners 50 may be formed by portions from a side rail 12 and an end rail 14. Corners 50 may be inserted between a side rail 12 and an end rail 14. Corners 50 may take on variable shapes, for example, corners may form substantially 90 degree angles and/or corners may be rounded taking on a curved shape. Parts of corner 50 portions may be overlapping when assembled.

The first side rail 12*a*, the second side rail 12*b*, the first end rail 14*a*, and the second end rail 14*b* may include a slat-rest 30, at least one slat rest 30 and/or a plurality of slat-rests 30. Slat-rests in this example are defined by the top surface of the top piece, e.g. top surface 30 of top piece 22*a*. The width and length of the slat-rest may be variable, so long as they are configured to support a slat. For example, the width and length of the slat-rest may be equal to the width and length of the top piece of a side rail. In many examples, the dimensions of the slat-rest will be less than that of the top surface area of the rail. For example, some slat-rests, e.g. those of the side or end rails, may be bound by a filler strip, e.g. strip 32.

FIGS. 5-9 show another example of a foundation according to the present disclosure. The foundation of FIG. 5 may include slats 34 positioned non-perpendicularly to side rails 12. Slats 34, as shown in FIGS. 5-8, may have differing lengths. For example, A slats may be considered to have a length L-A. B slats may be considered to have a length L-B, wherein L-B is greater than L-A. C slats may be considered to have a length L-C, wherein L-C is greater than L-B. D slat may be considered to have a length L-D. Lengths L-A, L-B, and L-C are each less than L-S. In many examples L-D will similarly be less than L-S. In some examples, the slats include a pair of A slats, a pair of B slats, a pair of C slats and a D slat, e.g., at least one pair, at least two pairs, or at least 3 pairs of the slats are substantially identical in length, e.g. within ±1 inch. In other examples, either more or fewer numbers of slats may be identical in length.

In this example, the slats may define an acute angle, referred to herein as, angle alpha and designated a. The slats 34 may define an angle alpha with the side rail 12. For a plurality of the slats, the angle alpha may be varied from 90 degrees, e.g. for at least 2, at least 3, at least 4, and at least 5, at least 6, or at least all of the slats. In some examples, the angle alpha includes at least one angle in the range of about 25 degrees to about 35 degrees. Applicant surprisingly has found that in some examples, an angle alpha between about 28 degrees and 30 degrees may provide the most improved mattress support. U.S. Pat. No. 8,935,819 to Hartley provides additional information regarding foundations with an angle alpha that is not 90 degrees, the disclosure of which is incorporated herein in its entirety.

In some aspects of the current disclosure, side rails may be considered to have a length L-S, and end rails may be considered to have a length L-E. The various dimensions of the various rails and rail components (e.g. top, bottom and filler pieces) may vary from example to example. Table 1 illustrates exemplary dimensions, which are in no way intended to be limiting. For example, fewer or more slats may change the illustrated dimensions in a manner that would be readily understandable to one of ordinary skill in the art, for example, using the disclosed slat angles α.

TABLE 1

| DESCRIPTION | TWIN | TWIN XL | FULL | QUEEN | SPLIT QUEEN | CAL KING |
|---|---|---|---|---|---|---|
| TOP END RAIL | 37½" | 37½" | 52½" | 59½" | 29½" | 35½" |
| TOP END FILLER | | | | | | |
| BOTTOM END RAIL | 37½" | 37½" | 52½" | 59½" | 29½" | 35½" |
| TOP SIDE RAIL | 74" | 79" | 74" | 79" | 79" | 83" |
| BOTTOM SIDE RAIL | 74" | 79" | 74" | 79" | 79" | 79" |
| TOP SIDE FILLER | 69" | 74" | 69" | 74" | 74" | 74" |
| TOP CENTER RAIL | 74" | 79" | 74" | 79" | 79" | 79" |
| BOTTOM CENTER RAIL | 69" | 74" | 69" | 74" | 74" | 74" |
| SLATS | 20" to 70" | 20" to 70" | 20" to 76" | A: 29" B: 52" C: 74" D: 76.5" | A: 29" B: 52" C: 74" D: 76.5" | 29" to 80" |
| CORNER BLOCK | 6.75" | 6.75" | 6.75" | 6.75" | 6.75" | 6.75" |
| CENTER BLOCK | 6.75" | 6.75" | 6.75" | 6.75" | 6.75" | 6.75" |
| SIDE BLOCK | 6.75" | 6.75" | 6.75" | 6.75" | 6.75" | 6.75" |

Figure 9:
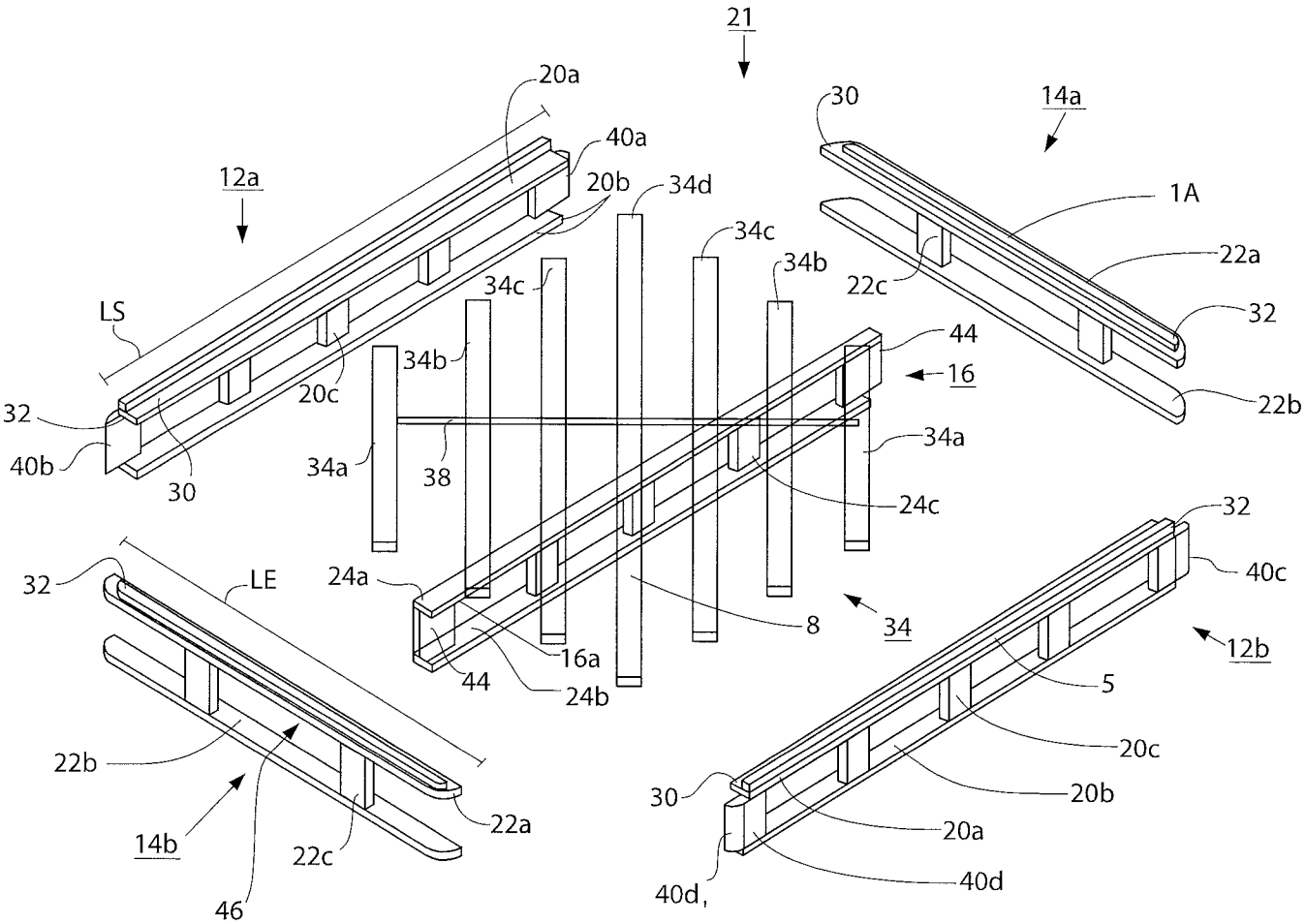
FIG. 9 shows a perspective view of one example of foundation parts that may be assembled into a foundation kit according to the present disclosure.

FIG. 1-8 may also be considered in the present disclosure as disclosing multiple embodiments of a foundation kit. FIG. 9, specifically shows, in one example, a foundation kit, referred to generally as kit 21. Kit 21 includes a first side rail 12*a*, a second side rail 12*b*, a first end rail 14*a*, a second end rail 14*b*, and, in some examples, at least one center rail 16. The kit 20 also includes a plurality of slats 34. The use of the term "first" and "second" with the various rails is provided for clarity and antecedent basis rather than to mean a particular order or position. Similarly, the use of "center" is only intended to mean that the center rail is positioned, at least in part, between either the first and second end rails or the first and second side rails. The at least one center rail may or may not be centrally positioned.

Kits may additionally include at least one center rail, e.g. center rail 16 as previously mentioned. Accordingly, kits may also include center blocks, e.g. center blocks 44, for interfacing center rails to end pieces. The number of center blocks may vary from example to example. For example, in kits having 2 center rails, 4 center blocks may be included. The interface of the center blocks to the center rails and end rails may be similar to as described for side and end rails. For example, each of the end rails may include a recess in between their end recesses for receiving at least a portion of the center block. For example, a recess 46 defined by top piece 22*a*, bottom piece 22*b*, and blocks 22*c*, may be considered a recess for receiving a portion of the center block. In many examples, the center blocks will be pre-interfaced with the center rail. Pre-interfacing may be achieved by a variety of ways, e.g. glue, nail, screw, etc.

Figure 10A:
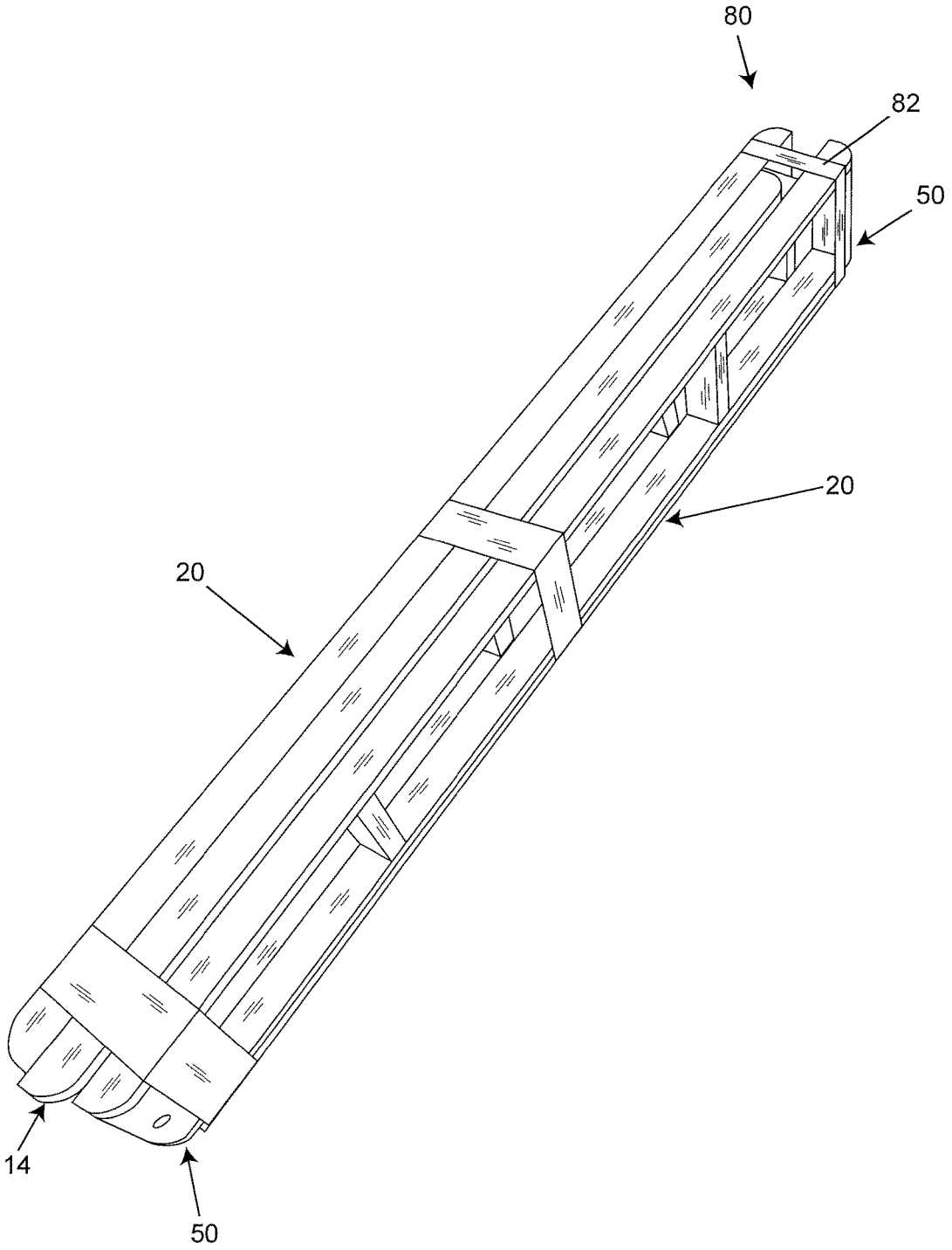
FIG. 10A shows a top perspective view of one example of a foundation kit according to the present disclosure.
Figure 10B:
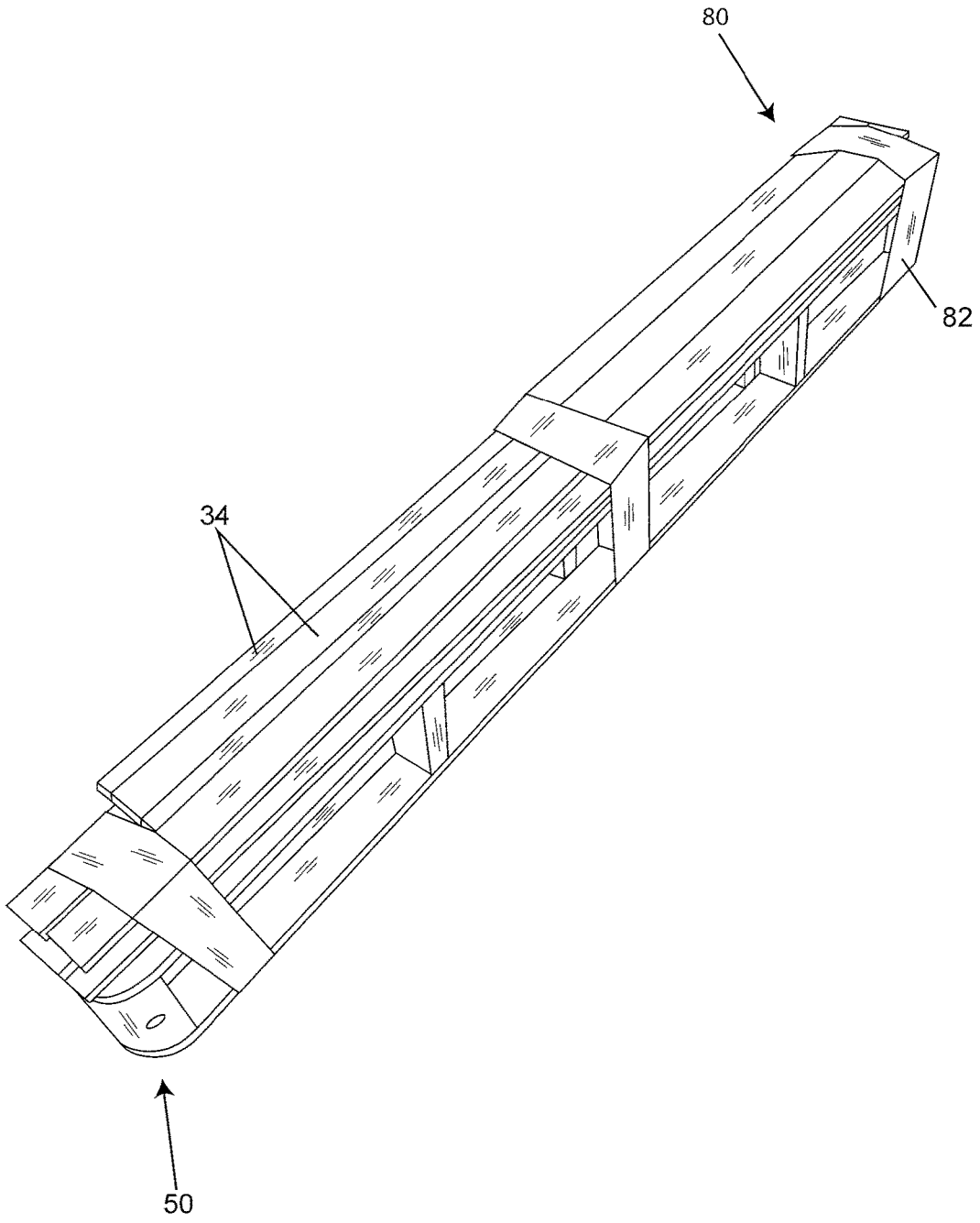
FIG. 10B shows a bottom perspective view of one example of a foundation kit according to FIG. 10A.
Figure 10C:
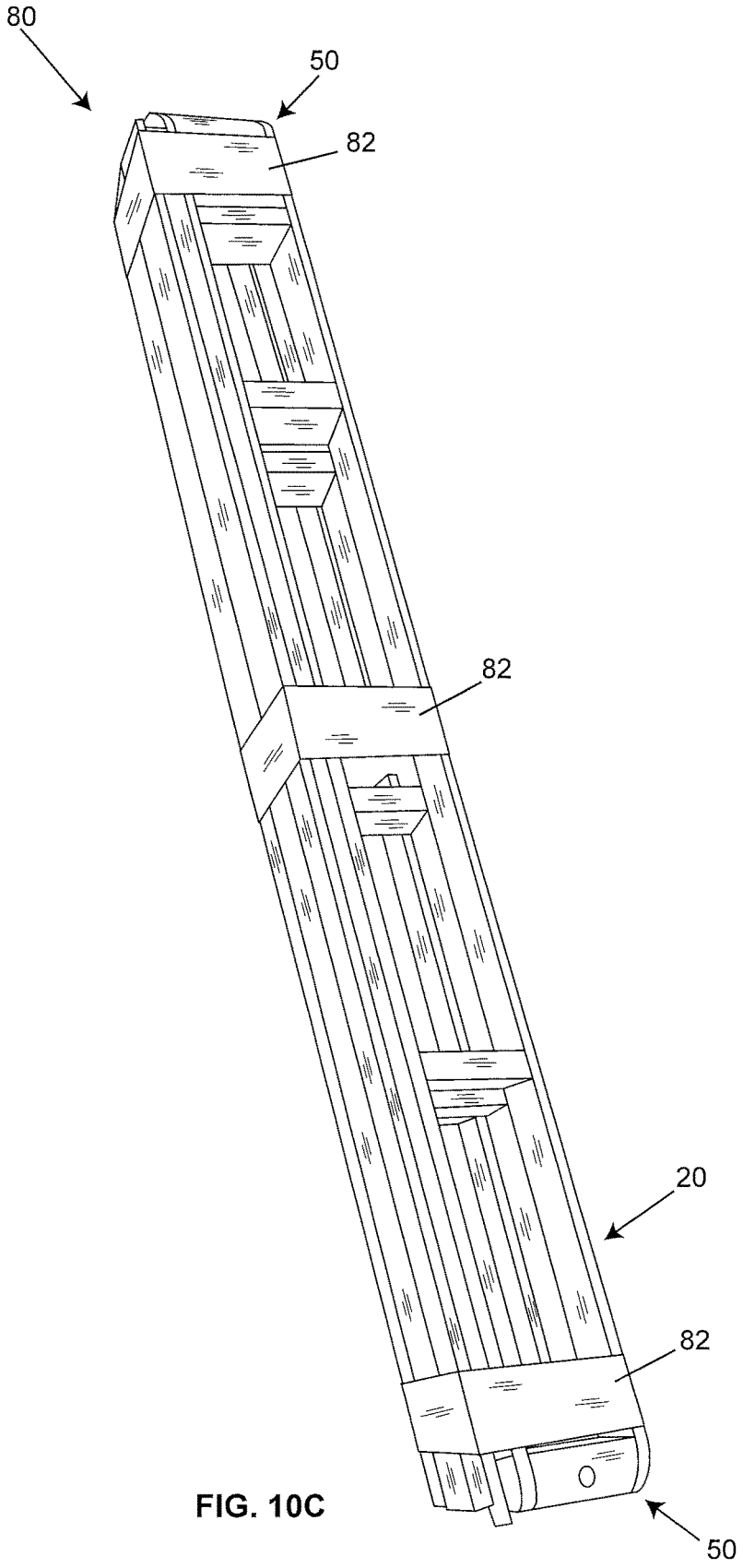
FIG. 10C shows a side perspective view of one example of a foundation kit according to FIG. 10A.
Figure 11A:
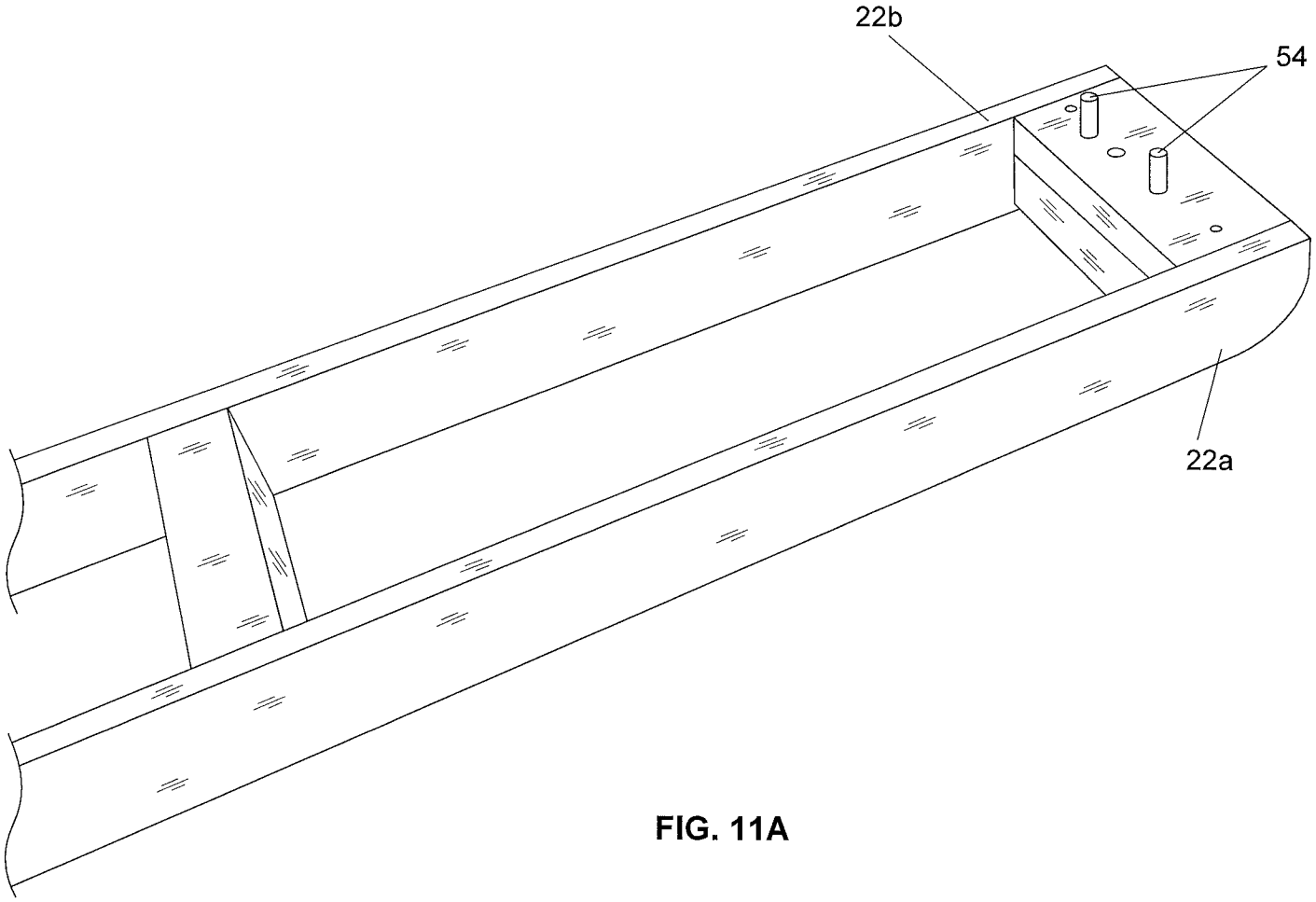
FIG. 11A shows one example of a foundation rail with an unassembled corner of the foundation according to the present disclosure.
Figure 11B:
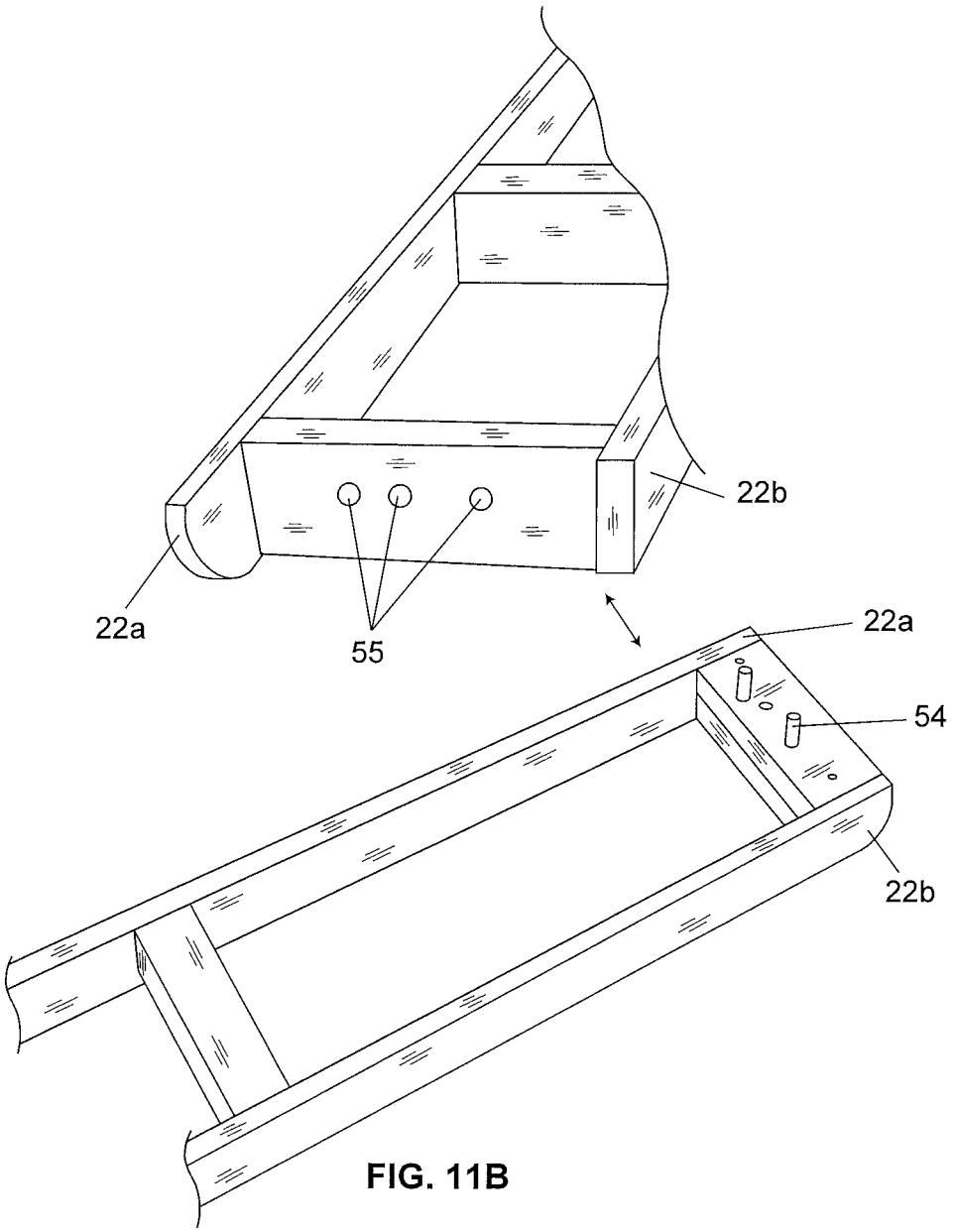
FIG. 11B shows one example of a foundation end rail portion and a foundation side rail portion with an unassembled corner of the foundation according to the present disclosure.
Figure 11C:
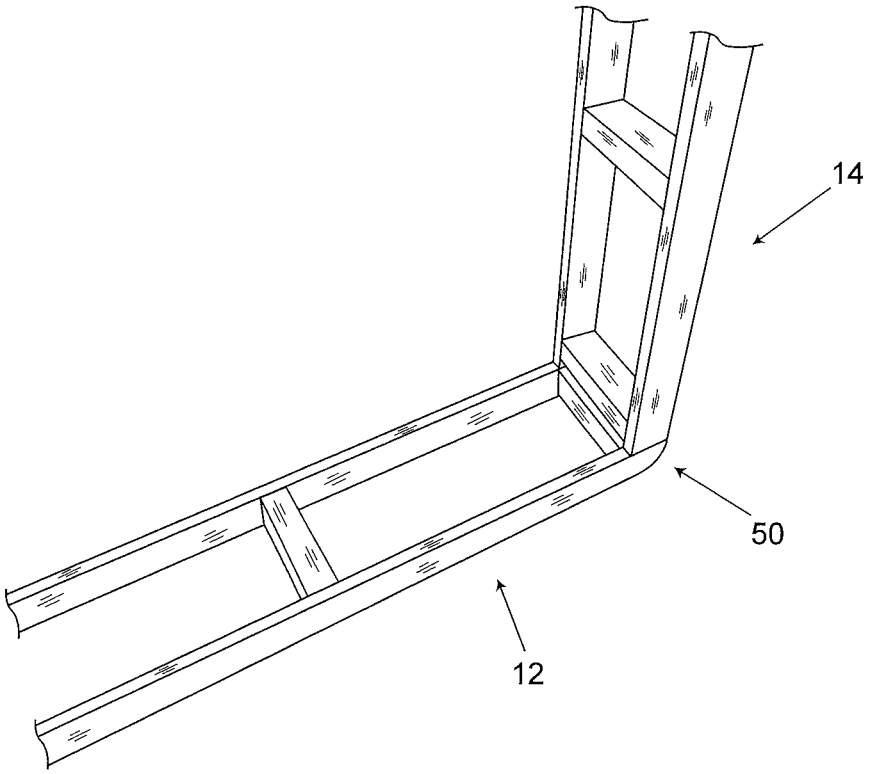
FIG. 11C shows one example of an assembled corner of the foundation rails of FIG. 11B.
Figure 11D:
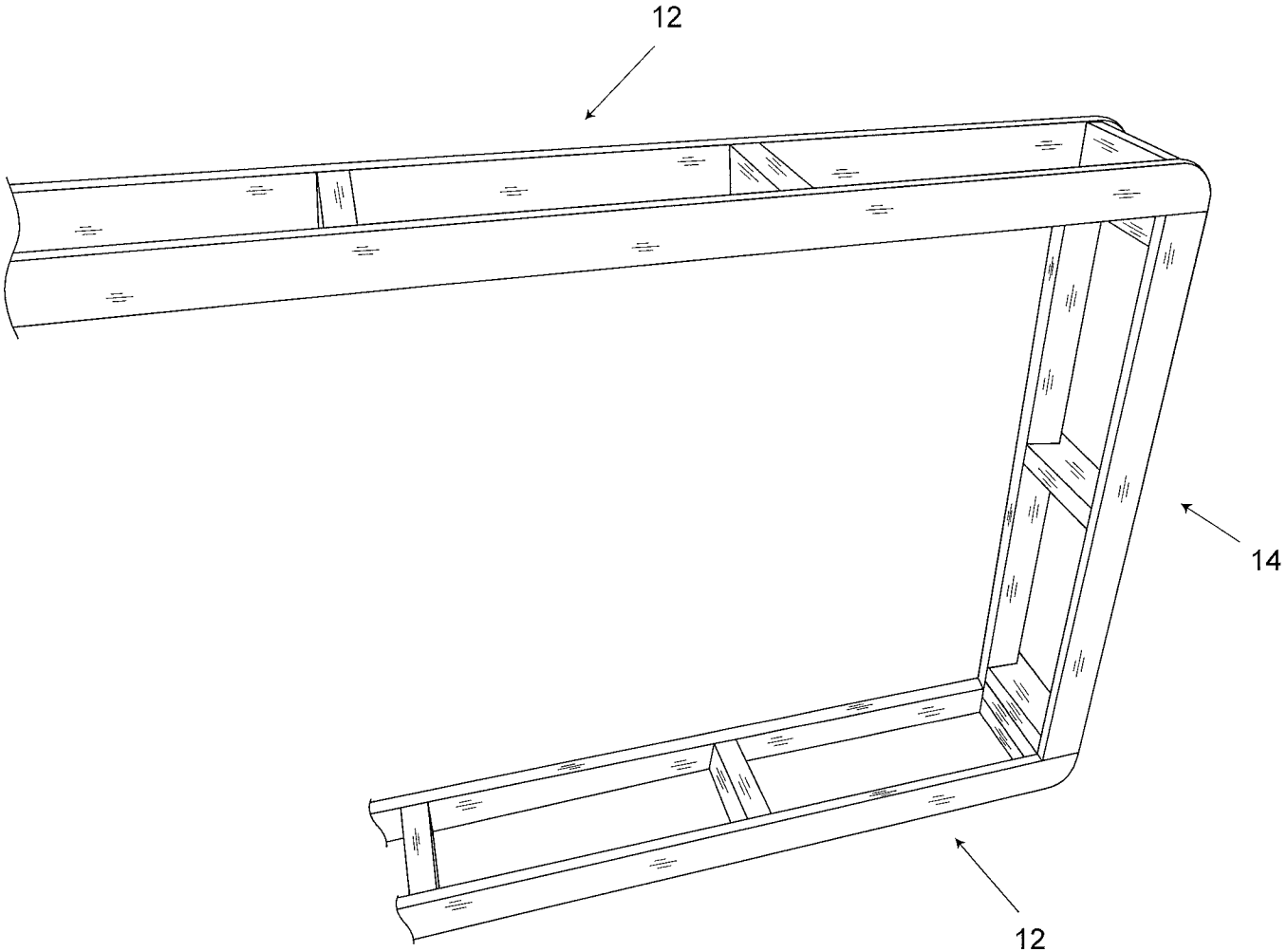
FIG. 11D shows a bottom view of one example of more than one assembled corner of the foundation as disclosed.
Figure 11E:
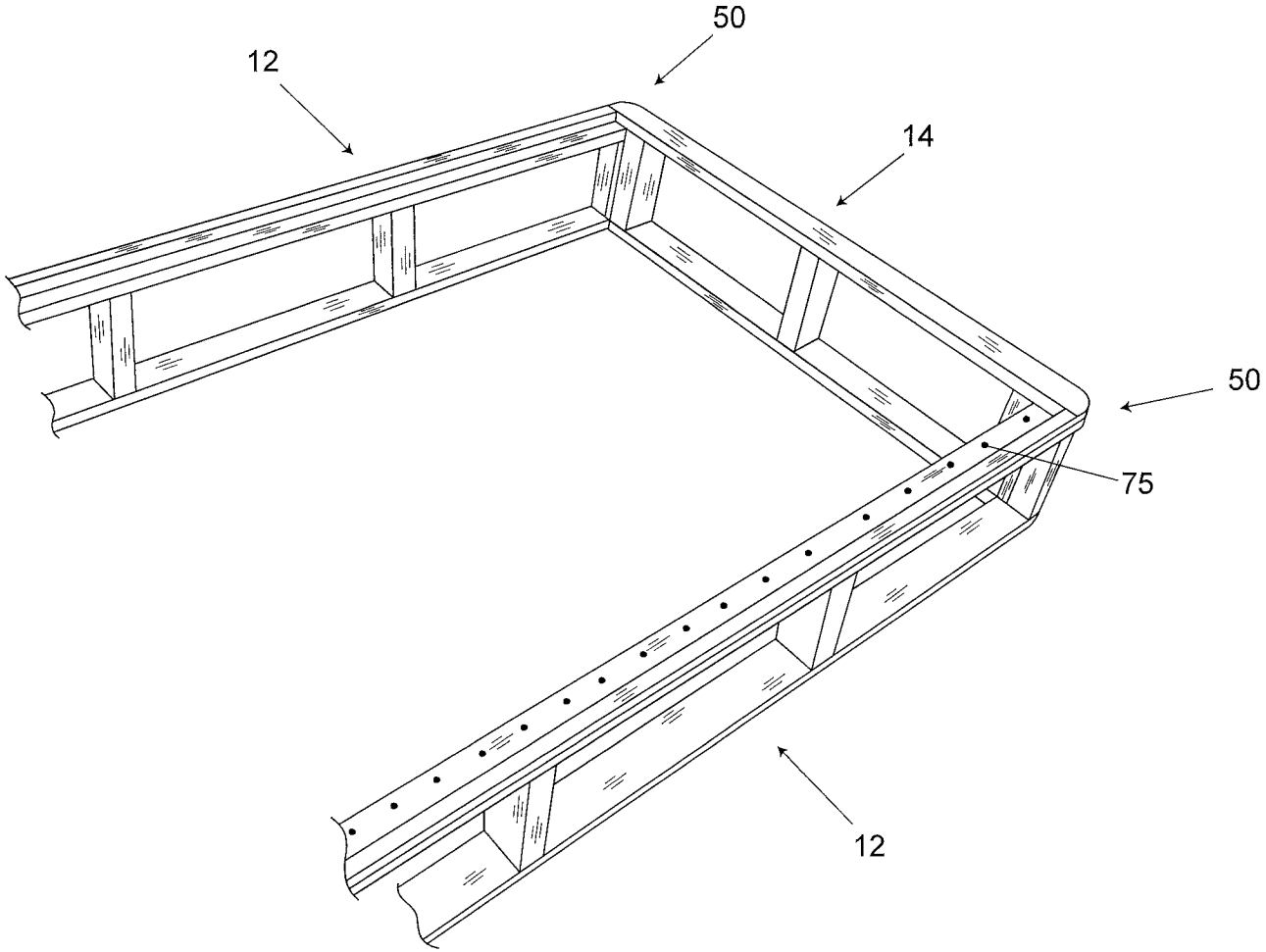
FIG. 11E shows a top view of one example of more than one assembled corner of the foundation as disclosed.
Figure 11F:
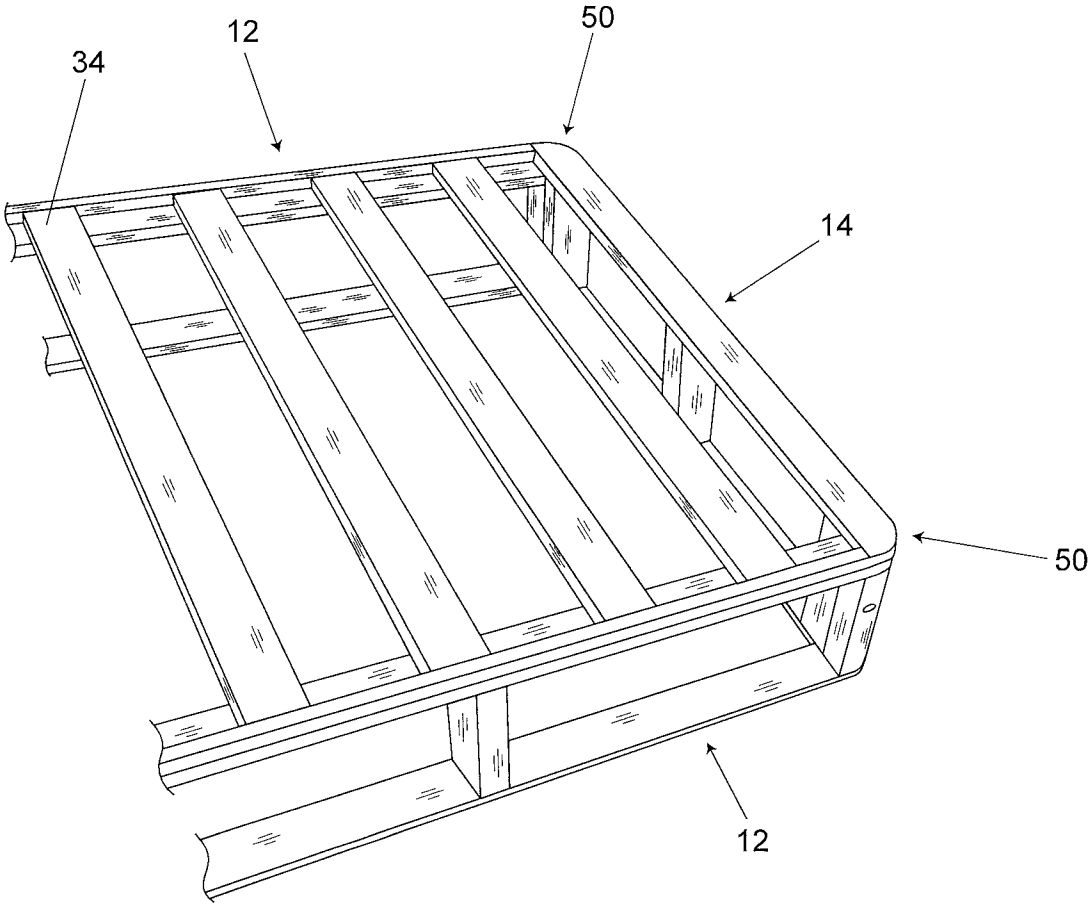
FIG. 11F shows a top view of one example of more than one assembled corner of the foundation of FIG. 11E with slats being added.
Figure 11G:
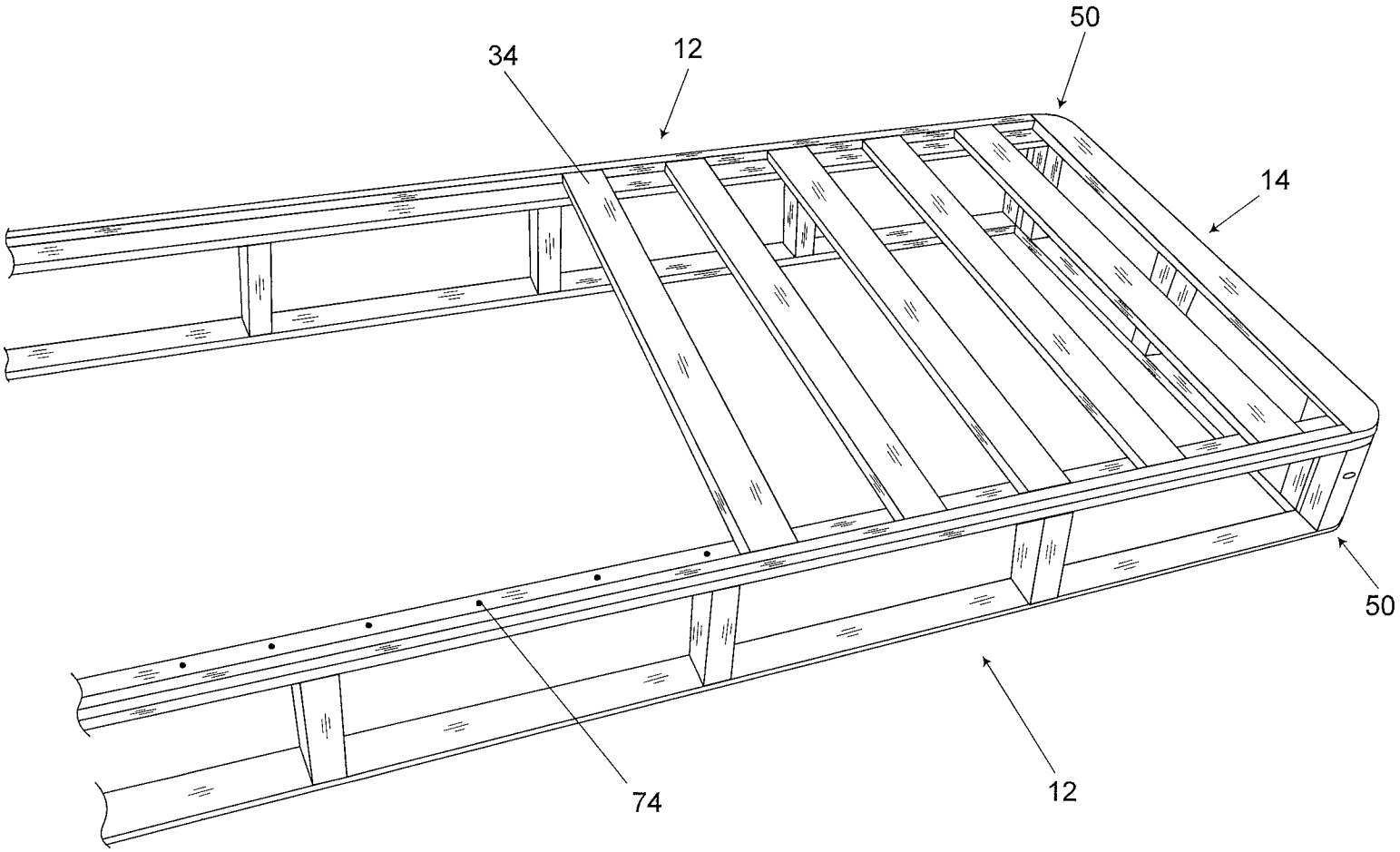
FIG. 11G illustrates one example of the progression of assembling the foundation of 11F.
Figure 11H:
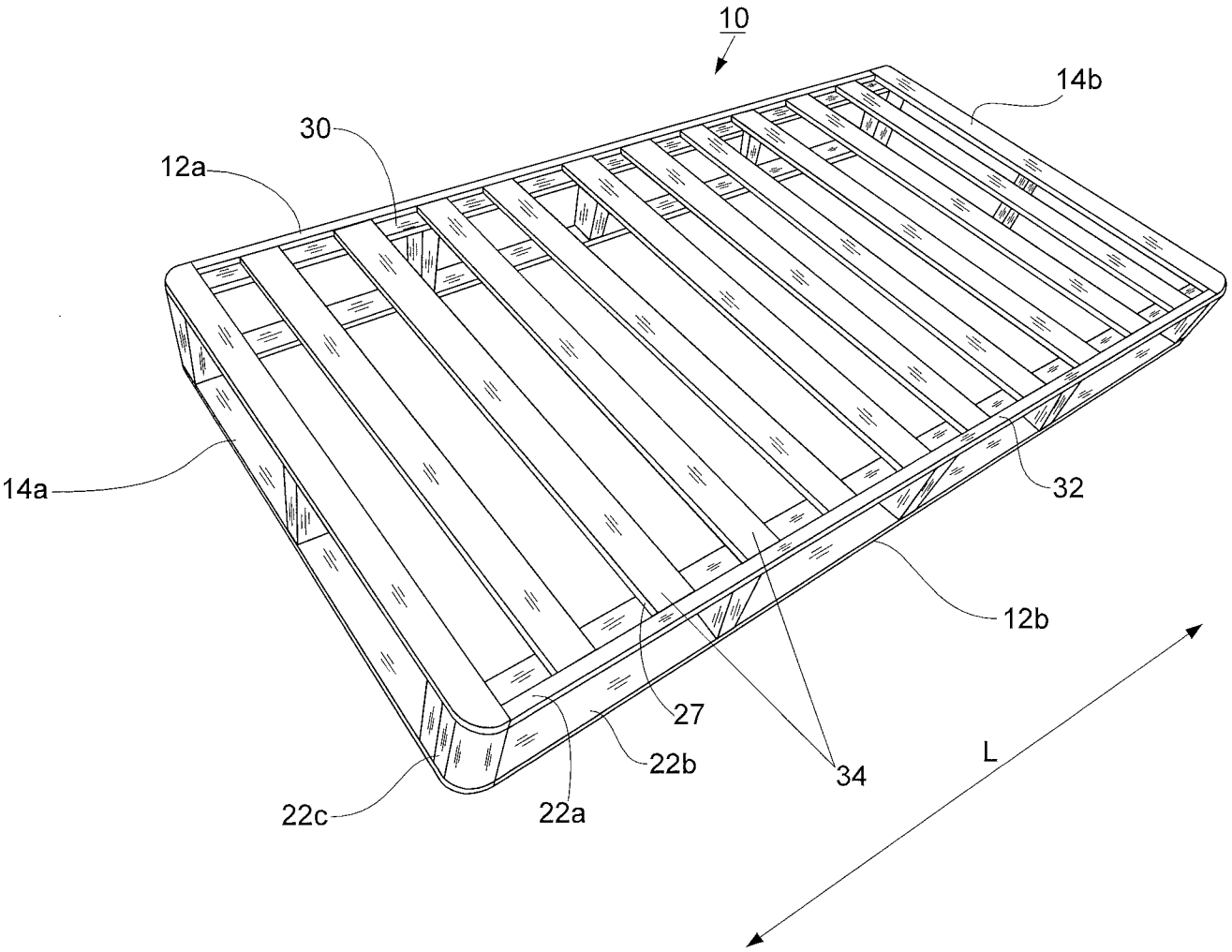
FIG. 11H shows one example of an assembled foundation according to FIGS. 11A-11F.
Figure 12A:
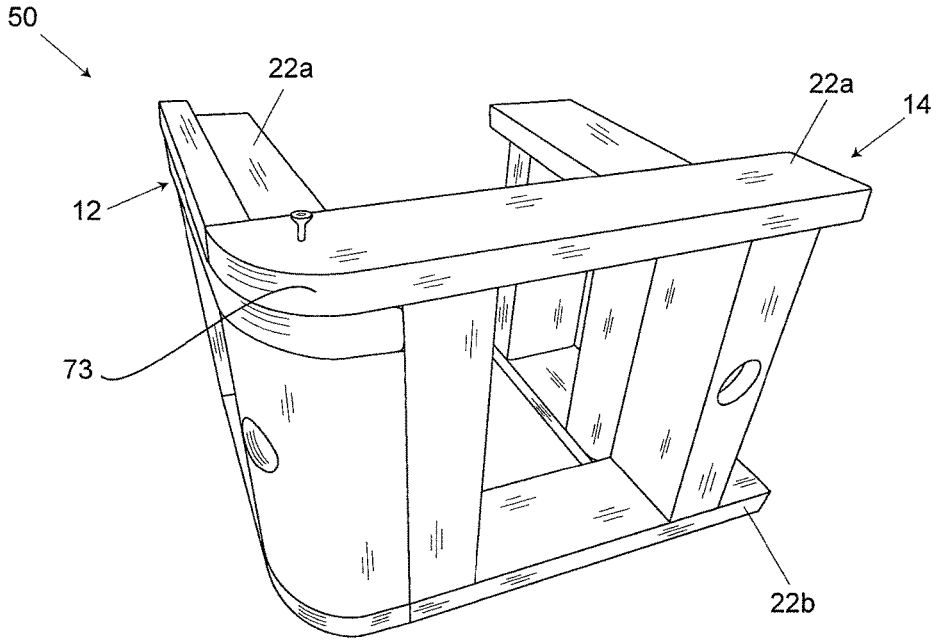
FIG. 12A shows a close-up side perspective view of one example of a foundation corner according to the present disclosure.
Figure 12B:
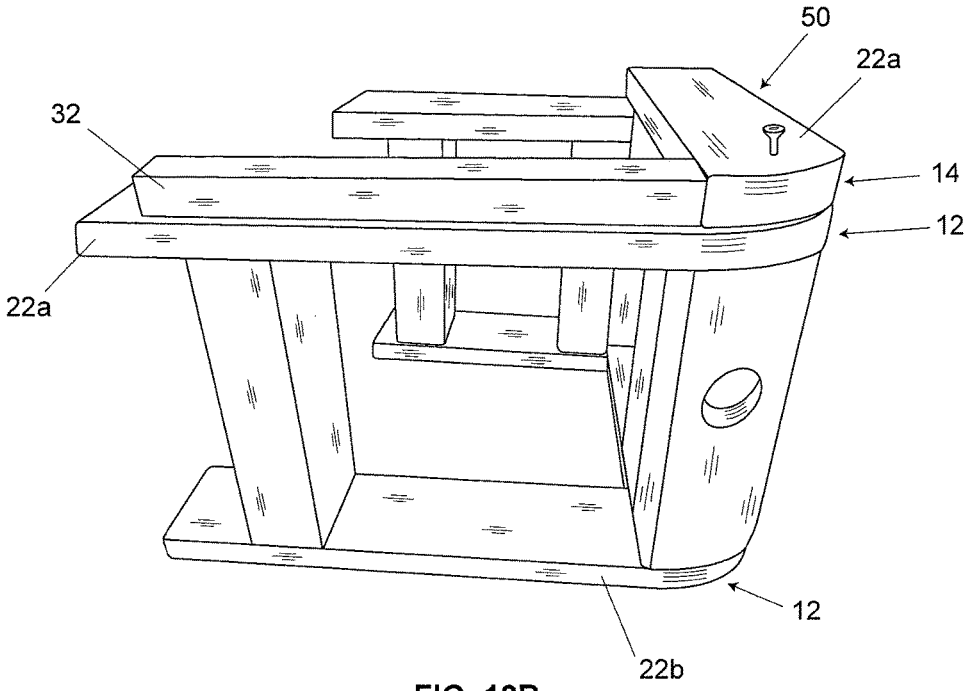
FIG. 12B shows another close-up side perspective view of a foundation corner according to FIG. 12A.
Figure 12C:
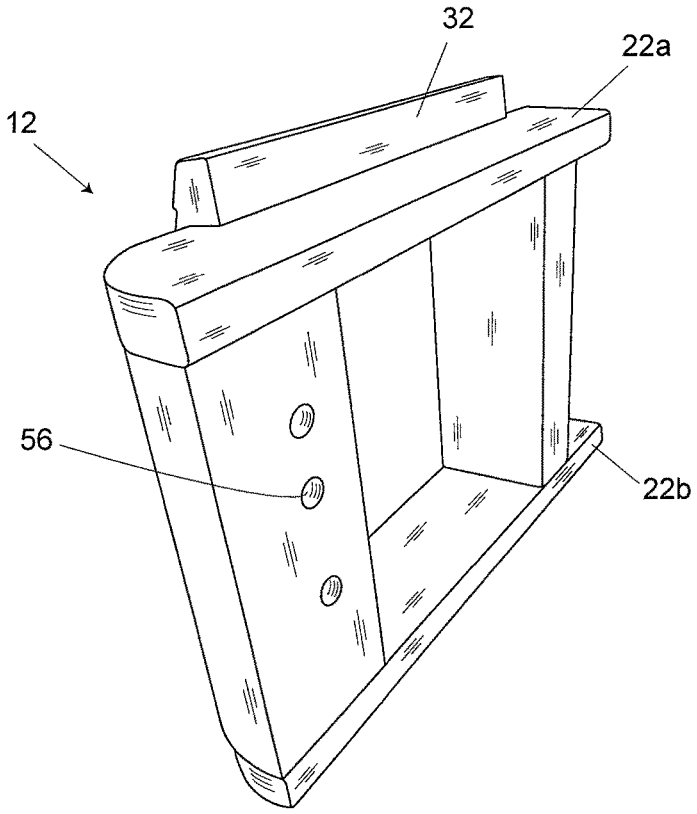
FIG. 12C shows an exploded view of one corner piece of the foundation according the FIG. 12A.
Figure 12D:
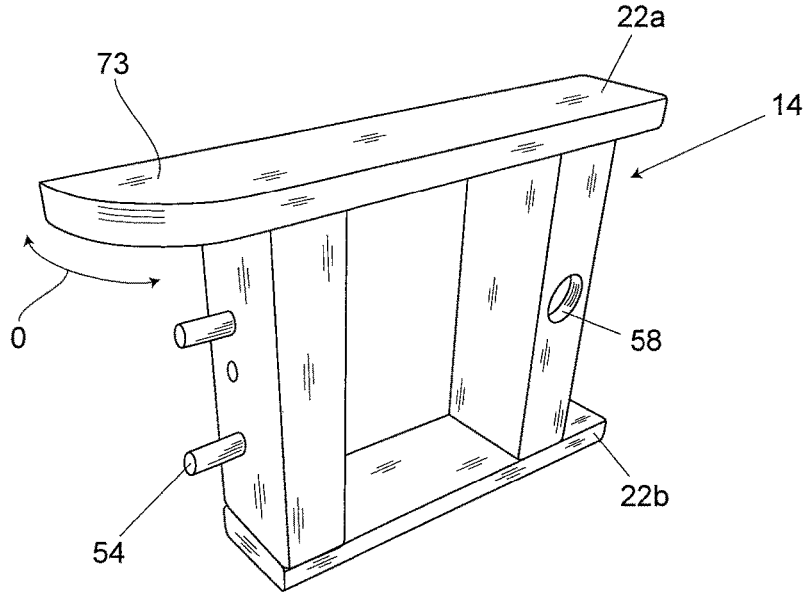
FIG. 12D shows an exploded view of another corner piece of the foundation according the FIG. 12A.
Figure 13A:
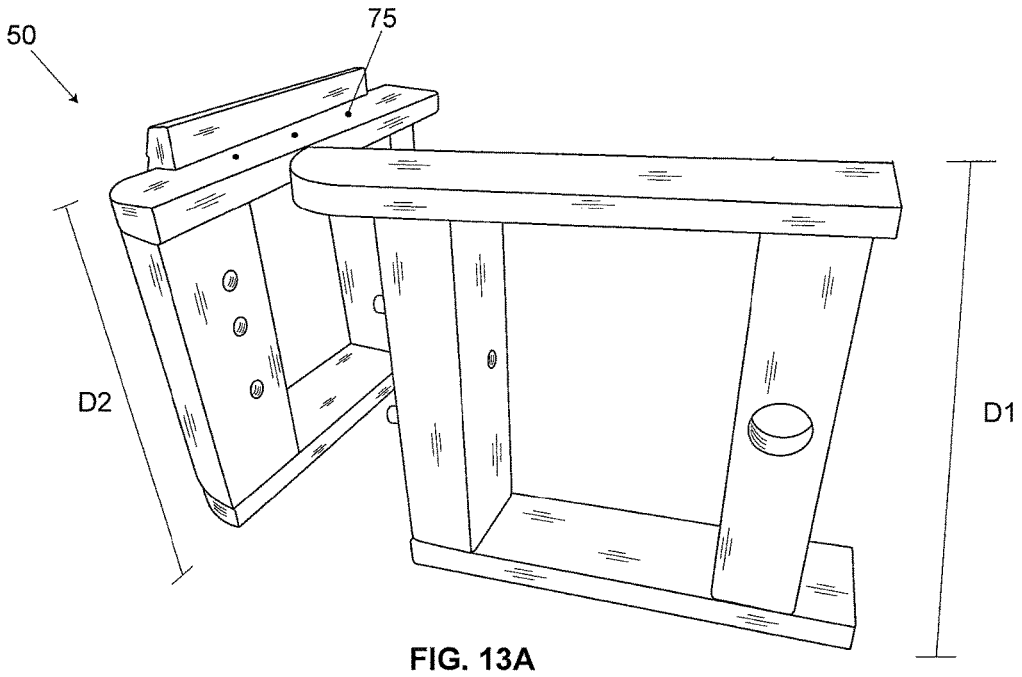
FIG. 13A shows an exploded close-up perspective view of another example of a foundation corner according to the present disclosure.
Figure 13B:
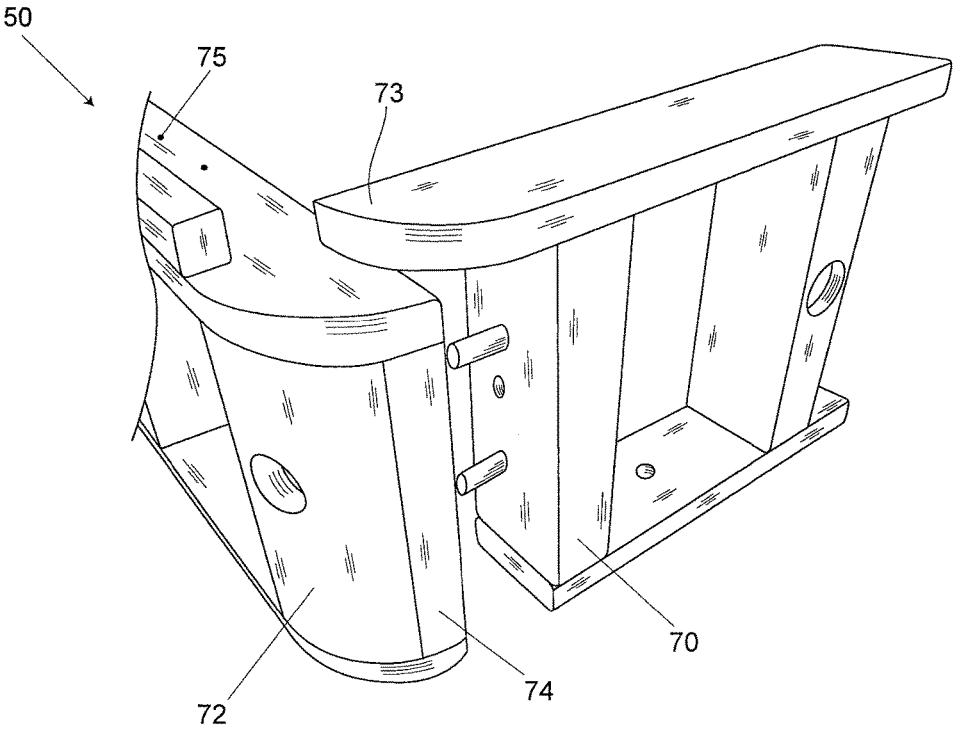
FIG. 13B shows an opposite exploded close-up perspective view of the foundation corner of FIG. 13A.
Figure 13C:
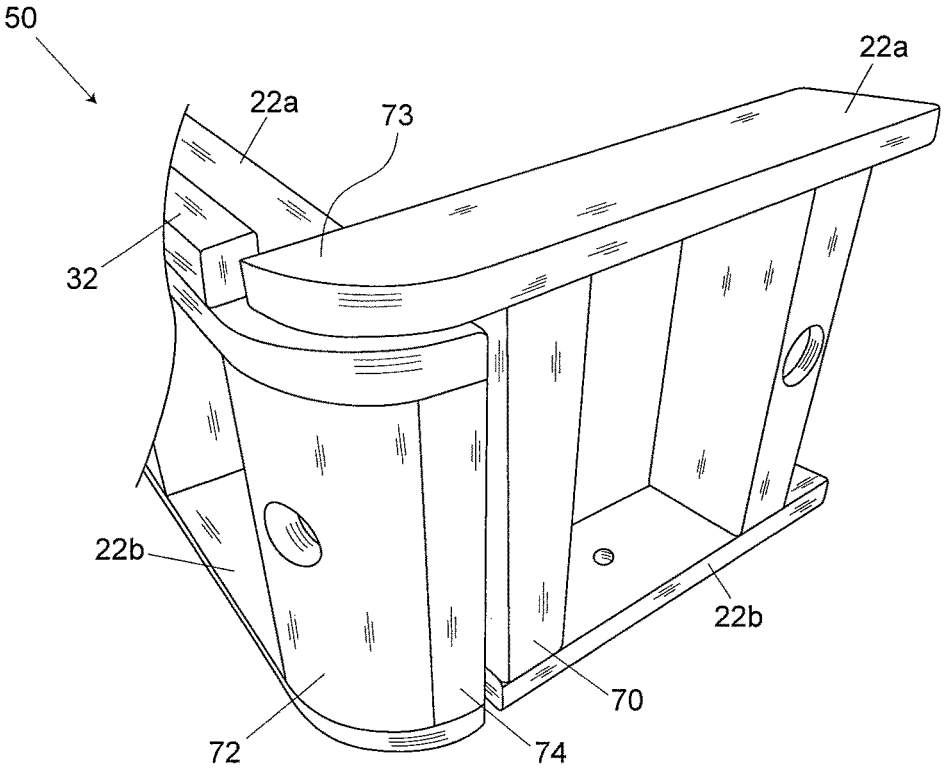
FIGS. 13C-13E illustrates assembly of the corner of FIG. 13A.
Figure 13D:
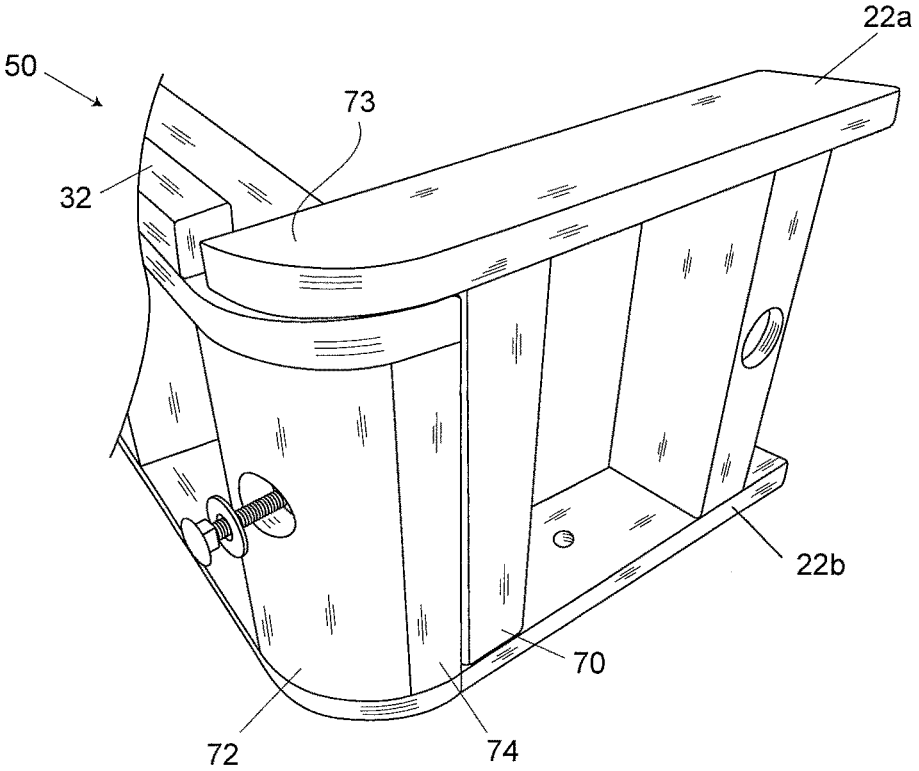
Figure 13E:
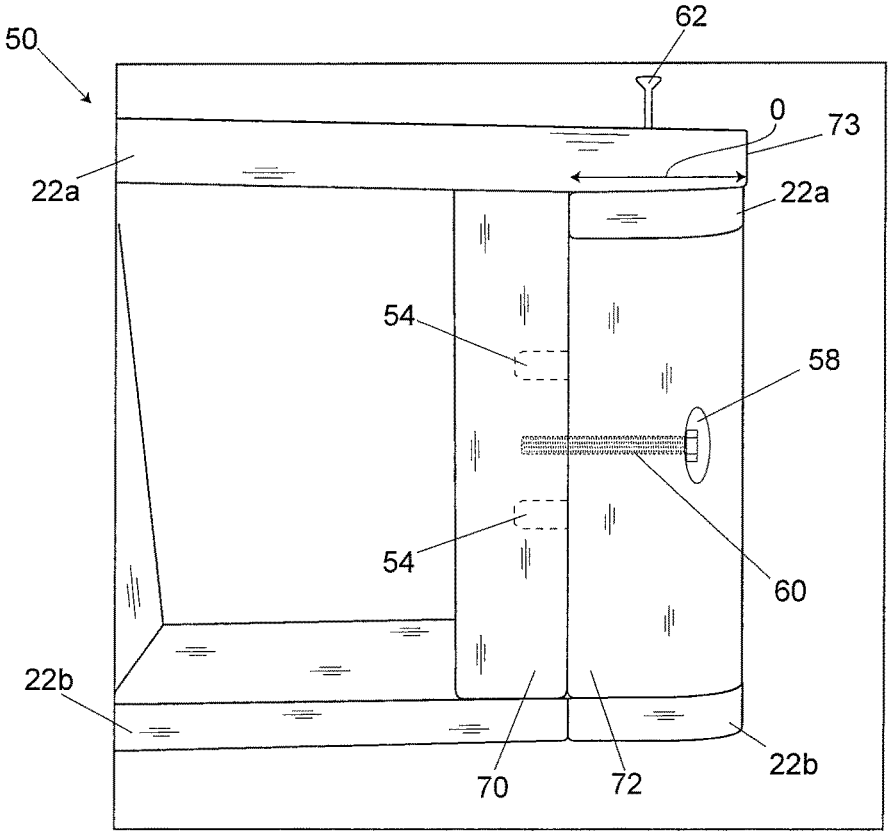
Figure 14A:
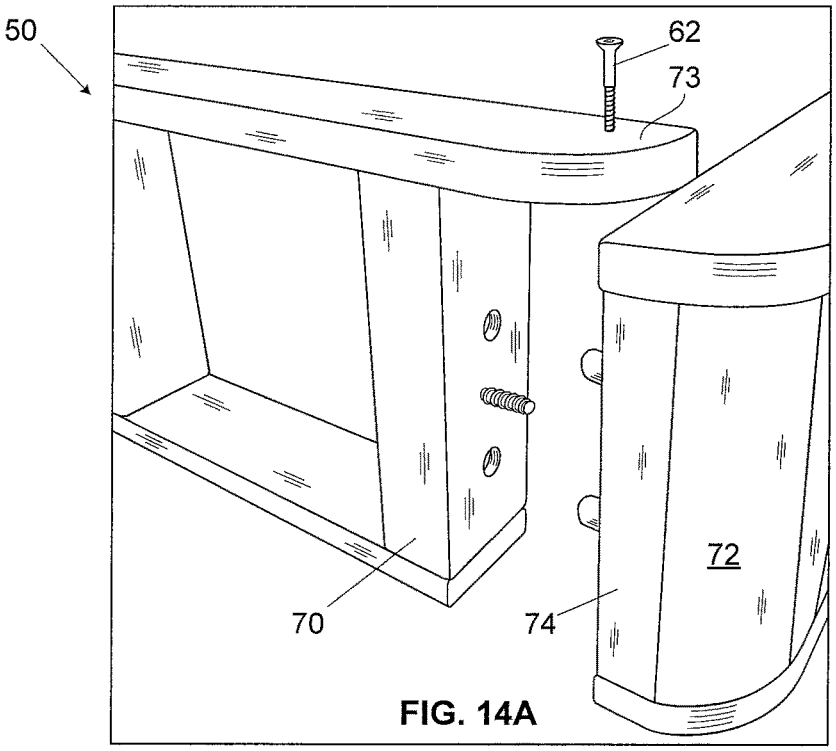
FIG. 14A shows an exploded close-up perspective view of another example of a foundation corner according to the present disclosure.
Figure 14B:
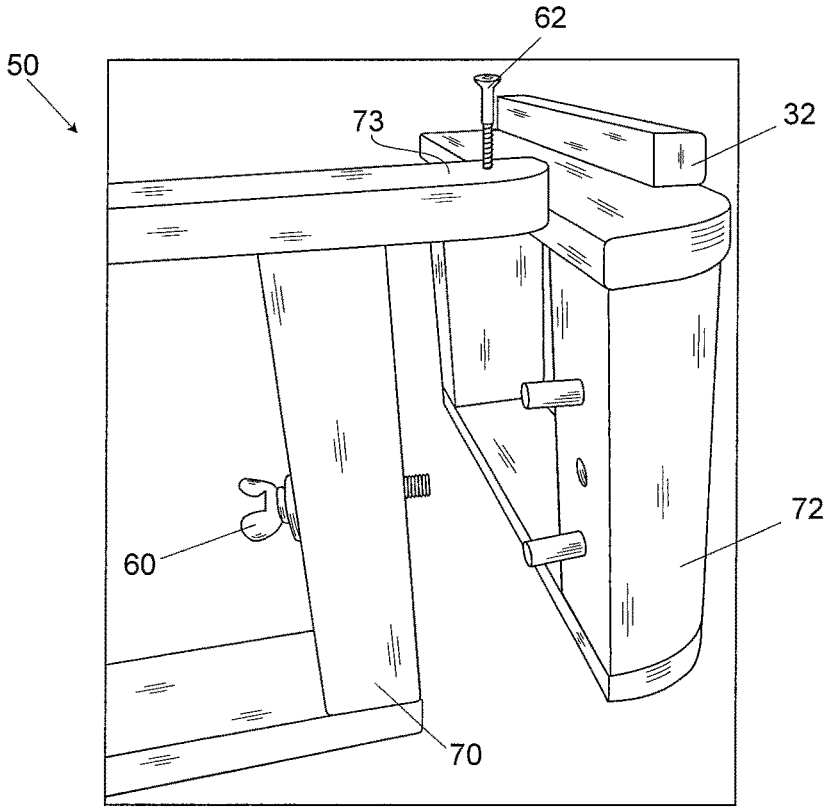
FIG. 14B shows an opposite exploded close-up perspective view of the foundation corner of FIG. 14A.
Figure 14C:
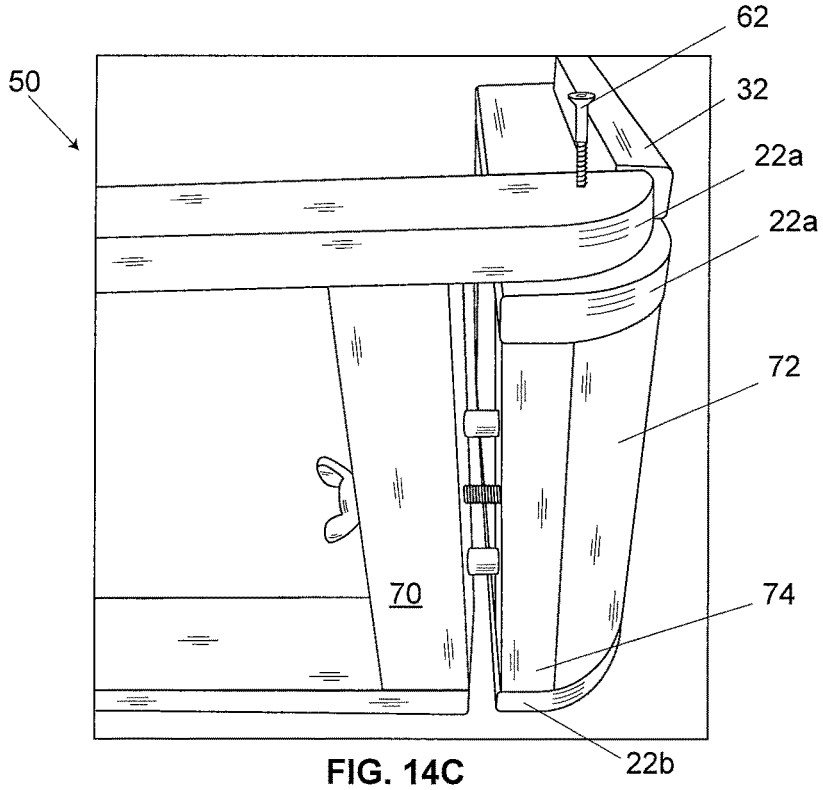
FIGS. 14C-14D illustrates assembly of the corner of FIG. 14A.
Figure 14D:
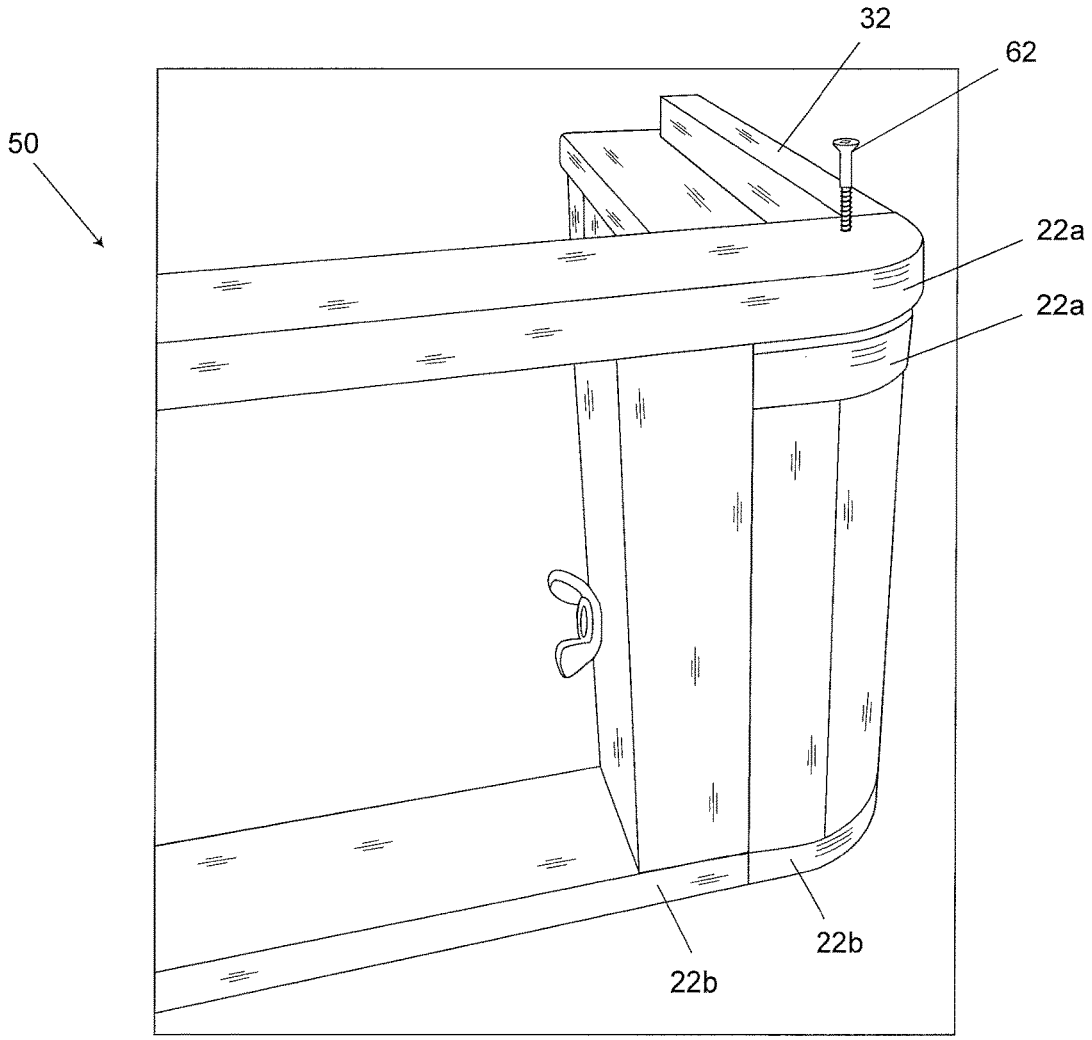

FIGS. 10A-10C show examples of bound foundation kits 80, as described, for shipping prior to assembly of the foundation. The bound foundation kits 80 may include binding 82 to secure the kit during shipping. The binding may, by way of example, include any means to secure the kit parts, such as, taping, wrapping, tying, etc.

FIGS. 12A-14D show various embodiments of foundation corners 50. Corners 50 may be considered a corner block made of one or more parts. The corner block, in some examples, interfaces, at least in part, a side rail 12 to an end rail 14. More than one corner block may be included in foundation 12, e.g. at least one of a first corner block 50*a*, a second corner block 50*b*, a third corner block 50*c* and a fourth corner block 50*d*. In this example, first corner block 50*a* is configured to interface the first side rail 12*a* to the second end rail 14*b*; the second corner block 50*b* is configured to interface the second side rail 12*b* to the second end rail 14*b*; the third corner block 50*c* is configured to interface the second side rail 12*b* to the first end rail 14*a*; and the fourth corner block 50*d* is configured to interface the first side rail 12*a* to the first end rail 14*a*. It should be clear however that the use of first, second, etc. to describe the corner blocks is for the purpose of antecedent basis, and not to impart any particular order of construction or position. In many examples, corner blocks will include a curvature or rounding, for example, to avoid sharp corners. Further, it should be clear that "block" is not intended to mean exclusively single piece construction. Although some of the example corner blocks illustrated may be considered to be made from a single piece of wood, in other examples, corner blocks include multiple piece components that are fitted together or fastened. Corner blocks will often include curvature, e.g., curvature 40*d*1 and 50, at an outside edge, e.g. to create a slightly rounded edge in the assembled foundation.

Corner blocks 50 may be configured to have a length that allows some portion of the corner block to be received by a recess in an end rail and another portion of the corner block to be received by a recess in the side rail. For example, at least 0.5" to 3" may be received by a recess of either the side or end rail. In other examples, more or less may be received, so long as sufficient structural integrity is maintained for use as a foundation. In many examples, at least one of the corner blocks will be pre-interfaced with a rail, e.g. either the side rail or the end rail. Corner blocks are shown, in some examples, as pre-interfaced with the side rails and the end rails, each which may contain at least one recess for receiving corner blocks.

In some examples, where the side rails 12 join the end rails 14, at the corners of the foundation frame, the side rail 12 and the end rail 14 may have an overlap O. In some instances, the overlap O is created by a portion of a top piece 22*a* of one of the rails extending over a portion of the top piece 22*a* of the other rail at the corner. The portions 22*a* of the top pieces of the rails 12 and 14 may have radiuses at their ends so that the radius edge is where the end rail and the side rail overlaps.

A block/spacer portion 74, that is extended and singular or more than one adjoined parts, may be included at the corner 50. A bottom portion 22*b* of the rails may meet flush at the corner without overlapping. The spacer portion 74 may aid in providing an offset establishing the overlap between the two top pieces 22*a* and 22*a* of the end and side rails. The overlap O portion of the top rail may be interchangeable such that the end rail 14 may contain the overlap and the side rail serve as the receiver of the overlap portion, and vice versa, the side rail may contain the overlap and the end rail serve as the receiving portion of the overlap. The overlap portion is also capable of being included on the bottom portion of the rails 22*b* instead of the top rails 22*a* or along with the top rails 22*a*.

An extended portion 73 of a rail may extend past an end support block 70 of the rail. The extended portion 73 may interface with an upper portion of the corner adjoining end rail. The corner adjoining end rail may include a corner spacer 74. The corner adjoining end rail may also include a rounded side 72 that may be a part of the corner spacer or adjoined to the corner spacer. To form the corner, in some examples, one of the rails may have an top portion 22*a* and a bottom portion 22*b* that are both in the same plane that is overlapped by the extended portion 73 of the adjoining corner rail.

The rails may be biased with the corner 50 so that only one end of the end rails will fit with one end of the side rails. Alternatively, the corners may be biased so that any end rail corner will fit with any side rail corner and/or the end rails are interchangeable with each other as they connect with the side rails.

The corner may be secured and stabilized by a first, second and/or third corner locking system. The corner may be a multi-locking corner system, for example, at least a double locking system and/or a triple locking system. Stabilizers 54 may be included that recess, fit into recesses 54, into one or each of the rails at an end portion and be included in the locking system. More than one stabilizer may be included. Adjoining fasteners 60, such as, for example a screw, screws, nails, and glue may be included to further secure the corners and be included in the locking system. The fasteners 60 may extend through recess 58 in the corners 50. A top stabilizer 62 may be included in the locking system. Top stabilizer 62 may be, by way of example, one or more of a screw, nail, and/or tack.

The results include mattress foundations, mattress foundation corners, kits and methods that allow for the creation of foundations having increased stability and support. In some examples, the side rails and the end rails may have differing heights from their bottom piece to their top piece D1 and D2. The differing heights may contribute to creating a space for the overlap between the side and end rails at the corners. The differing height distances may be interchangeable so that D1 may be the height distance of the end rail or the side rail with D2 being the distance of the other rail.

During assembly, one example of which is seen in FIG. 11A-11H, the rails are assembled with the overlapping rails forming a secured corner 50, and typically the slats 34 are interfaced with the slat rests 30, e.g., by glue, nail, screw, etc. The slat rests are generally configured so that the tops of the installed slats will be at substantially the same height as each other, the top piece 22*a* and/or the filler strip 32. Because of variability in construction materials, however, there may be some variability in the assembled slat height, e.g. H±0.5 inches.

When assembled, the slats may define an acute angle $\alpha$. For example, the slats may define an angle $\alpha$ of about 90°. In other examples, A slat, B slat, and C slat each define an angle $\alpha$ with the side rail that is not 90° for at least a plurality of slats, e.g for at least 2, at least 3, at least 4, at least 5, at least 6, or at least all of the slats. In many examples, the angle $\alpha$ includes a least one angle in the range of 25° to 35°.

Spacer markings 75 may be useful for serving any of a variety of purposes, including indicating where the slats are to be placed when assembling the foundation. Markings 75 may indicate, for example, where to center the slats 34 and/or serve as indicators of where the place the slats between. Spacer markings may also be useful for maintaining a predetermined distance between the slats. Distances may vary, for example based on slat number and the size of the foundation being constructed. In many examples, spacer markings will maintain a distance between slats in the range of 5" to 12", more typically in the range of 6" to 10". The spacer marks 75 may be pre-drilled or, by way of example marked on the rails.

The mattress foundation may include feet that attach to the underside of the foundation to lift the mattress foundation off of the ground. The feet may be located anywhere on the underside of the foundation, for example, the corners and/or the rails.

The current disclosure is also directed to a variety of methods. In one embodiment, the disclosure is directed to methods of assembling kits for shipping. In one example, a method includes manufacturing a first side rail having a slat-rest and a length L-S and manufacturing a second side rail for positioning parallel to the first side rail, the second side having a slat-rest. The example may also include manufacturing a first end rail configured to interface with the first side and the second side and a second end rail configured to interface with the first side rail and the second side rail at a corner with an overlap. The first end rail and the second end rail may each have a slat rest. The example may also include manufacturing at least one center rail configured to interface with the first end rail and the second end rail, wherein the at least one center rail may have a slat-rest. The center rail, side rails, and end rails may be similar to any of those previously described. The method may also include manufacturing at least one rail with an overlap portion. The method may also include a corner spacer 74 included on one of the rails. The method may also include rounding the ends of both corner portions formed at the end of both an end rail and the side rail.

In another example, the method also includes manufacturing a plurality of slats including at least an A slat having a length L-A, a B slat having a length L-B, wherein L-B is greater than L-A, and a C slat having a length L-C, wherein L-C is greater than L-B. Typically L-A, L-B, and L-C are each less than L-S.

Once manufactured, methods may also include orienting the first side rail, the second side rail, the first end rail, the second end rail, the at least one center rail, and the plurality of slats in a substantially parallel longitudinal orientation for at least one of shipping or storage. Typically, the oriented kit will be bound to maintain its orientation for a desired duration, e.g. until assembly. Binding may be by any material having the strength sufficient to maintain the kit in the orientation, e.g., wire, plastic strapping, packaging tape, etc.

Methods of the current disclosure are also directed to assembling a foundation for a mattress. In one example, a method includes receiving a kit, such as any of the described above. For example, the kit may include a first side rail having a slat-rest and a length L-S; a second side rail having a slat-rest; a first end rail; a second end rail; and a plurality of slats. The plurality of slats may vary from example to example. For example, they may include an A slat having a length L-A, a B slat having a length L-B, wherein L-B is greater than L-A, and a C slat having a length L-C, wherein L-C is greater than L-B. Other slats may also be included. Typically, L-A, L-B, and L-C are each less than L-S. The side rails and/or the end rails may include overlapping corners as described above that are assembled to form a corner. The corner may be secured by way of at least a first, second, and/or third locking system.

Assembly methods may also include positioning the first side rail, the second side rail, and the at least one center rail in parallel (if included); interfacing the first end rail with the first side rail, the second side rail, and the at least one center rail; and interfacing the second end rail with the first side rail, the second side rail, and the at least one center rail. Additionally included may be overlapping at least a portion of the rails at the corners. The interfacing may create slat-rests having a similar height.

Once the rails are interfaced, the plurality of slats may be positioned on the plurality of slat-rests to create the following sequence: A slat, B slat, and C slat. In many examples, as described above, the sequence may be symmetrical, e.g: A slat, B slat, C slat, C slat, B slat, A slat. Other examples, include A slat, B slat, C slat, D slat, C slat, B slat, A slat. FIG. 11 illustrate a partially assembled kit example, with several slats resting on slat-rests.

Methods also include attaching the A slat, the B slat and the C slat such that each define an angle $\alpha$ with side rails when installed. As noted above, in this example, a plurality of slats will have an angle $\alpha$ that is not 90°. More typically, at least a plurality of the slats will include at least one angle in the range of 25° to 35°. Rails will often also include filler strips, e.g. filler strips. Prior to attachment, proper slat positioning may be facilitated, at least in part, by abutting the ends of one of the terminal slats, e.g an A slat against the filler strip of a side rail and the filler strip of an end rail, and then performing a similar step for the opposite terminal slat, e.g. the opposite A slat if symmetrical slat construction is used. The result is that, when the spacer marks are used, all slats in between the terminal slats should be approximately positioned in their desired angular and/or substantially perpendicular orientation, requiring only minimal adjustment before attachment. Similar positioning may also be achieved without the use of markers, for example, by abutting the ends of each slat against filler strips. Proper positioning may be achieved by the shape of the slat ends, etc.

The disclosure provided herein thus provides a variety of improvements in the art including increased mattress support and stability. In addition, foundations as disclosed herein will often provide better support to memory foam type mattresses, which applicant believes exhibit the potential for unnecessary sagging under existing technologies.

Numerous characteristics and advantages have been set forth in the foregoing description, together with details of structure and function. The disclosure, however, is illustrative only, and changes may be made in detail, especially in matters of shape, size, and arrangement of parts, within the principle of the invention, to the full extent indicated by the broad general meaning of the terms in which the general claims are expressed.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges subsumed therein, and every number between the end points. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10, as well as all ranges beginning and ending within the end points, e.g. 2 to 9, 3 to 8, 3 to 9, 4 to 7, and finally to each number 1, 2, 3, 4, 5, 6, 7, 8, 9 and 10 contained within the range. Additionally, any reference referred to as being "incorporated herein" is to be understood as being incorporated in its entirety.

It is further noted that, as used in this specification, the singular forms "a," "an," and "the" include plural referents unless expressly and unequivocally limited to one referent.

Certain modifications and improvements will occur to those skilled in the art upon a reading of the foregoing description. It should be understood that all such modifications and improvements have been deleted herein for the sake of conciseness and readability but are properly within the scope of the following claims.

I claim:

1. A mattress foundation comprising:

a first side rail having a slat-rest, a second side rail for positioning parallel to the first side rail, the second side rail having a slat-rest, a first end rail configured to interface with the first side rail and the second side rail, a second end rail configured to interface with the first side rail and the second side rail, a plurality of slats, and a corner between each of the interfaces of the side rails and end rails, wherein the corner is formed by the overlap of at least one of the end portions of the end rails and at least one of the end portion of the side rails, and wherein an opposite end portion of the side rail and an opposite end portion of the end rail meet flush with one another wherein the overlap of at least one of the end portions and the meeting of an opposite end portion of the side rail and the opposite end portion of the end rail at a flush position are separated by a spacer and an end support block positioned below the slat-rests and between a top interface of the side rails and end rails and a bottom interface of the side rails and end rails at the corner.

2. The mattress foundation of claim 1 wherein the first end rail and the second end rail include slat rests.

3. The mattress foundation of claim 1 wherein at least one of the end rails has a height that is not equal to a height of at least one of the side rails.

4. A mattress foundation comprising:

a first side rail having an adjoined top piece and a bottom piece, a second side rail having an adjoined top piece and a bottom piece for positioning parallel to the first side rail, a first end rail having an adjoined top piece and a bottom piece and, configured to interface with the first side rail and the second side rail, a second end rail having an adjoined top piece and a bottom piece and configured to interface with the first side rail and the second side rail, a plurality of slats, and a corner formed between each of the interfaces of the side rails and end rails, wherein the corner includes:

a corner spacer located between a top portion and a bottom portion of a first rail end, a rounded portion adjoined to the corner spacer, an extended rail portion extending beyond a second rail end at an end block support located between a top portion and a bottom portion of the second rail end, wherein the extended rail portion of the second rail end is configured to overlap the top and bottom portions of the first rail end so that the end block support mates with the corner spacer on an opposite side of the corner spacer than the rounded portion, and wherein the end block support has a height that is greater than a height of the corner spacer.

5. The mattress foundation of claim 4 including a double locking corner system.

6. The mattress foundation of claim 4 including a triple locking corner system.

7. The mattress foundation of claim 4 including a filler strip on the first side rail and the second side rail.

8. The mattress foundation of claim 7 wherein the extended portion aligns with the filler strips.

9. The mattress foundation of claim 4 wherein at least two of the rails have a height distance greater than the other two rails.

10. The mattress foundation of claim 4 wherein two of the rails foaming the corner overlap and two of the rails abut flush into one another.

11. The mattress foundation of claim 4 including a plurality of stabilizers at a first rail end that recess into a plurality of recesses at the other rail end, an adjoining fastener that extends throughout one of either the first or second rail ends and into the other rail end.

12. The mattress foundation of claim 11 including a fastener that protrudes through the overlap rail portion and into the rail end portion that receives the overlap portion.

* * * * *